US007384140B2

(12) United States Patent
Kojima et al.

(10) Patent No.: US 7,384,140 B2
(45) Date of Patent: Jun. 10, 2008

(54) LIQUID DROPLET EJECTING APPARATUS, LIQUID DROPLET EJECTING SYSTEM, ELECTRO-OPTICAL DEVICE, METHOD OF MANUFACTURING ELECTRO-OPTICAL DEVICE, METHOD OF FORMING A METAL WIRING LINE, AND ELECTRONIC APPARATUS

(75) Inventors: Kenji Kojima, Suwa (JP); Tatsuo Yoda, Tatsuno-machi (JP)

(73) Assignee: Seiko Epson Corporation (JP)

( * ) Notice: Subject to any disclaimer, the term of this patent is extended or adjusted under 35 U.S.C. 154(b) by 257 days.

(21) Appl. No.: 10/739,906

(22) Filed: Dec. 18, 2003

(65) Prior Publication Data

US 2004/0233265 A1 Nov. 25, 2004

(30) Foreign Application Priority Data

Dec. 19, 2002 (JP) ..... 2002-369061

(51) Int. Cl.
*B41J 2/01* (2006.01)

(52) U.S. Cl. ..... 347/102; 347/101

(58) Field of Classification Search ..... 347/102, 347/106, 2, 4, 8, 101, 100, 96; 349/189; 358/505; 430/7
See application file for complete search history.

(56) References Cited

U.S. PATENT DOCUMENTS 4,891,242 A * 1/1990 Ito et al. ..... 427/98.5
5,296,873 A * 3/1994 Russell et al. ..... 346/25
5,707,684 A * 1/1998 Hayes et al. ..... 427/162
5,872,579 A * 2/1999 Handa et al. ..... 347/8
5,921,451 A * 7/1999 Bolza-Schunemann ..... 226/18
5,989,757 A * 11/1999 Satoi ..... 430/7
6,331,384 B1 12/2001 Satoi
6,340,225 B1 * 1/2002 Szlucha ..... 347/102
6,463,674 B1 * 10/2002 Meyers et al. ..... 34/304
6,623,097 B2 9/2003 Okada et al.
6,959,986 B2 * 11/2005 Ushirogouchi et al. ..... 347/100
2002/0105688 A1 * 8/2002 Katagami et al. ..... 358/505
2004/0046850 A1 * 3/2004 Domoto et al. ..... 347/102
2004/0191408 A1 9/2004 Okada et al.
2006/0254508 A1 11/2006 Okada et al.

FOREIGN PATENT DOCUMENTS

JP 01011841 A * 1/1989
JP 08-313721 11/1996
JP 9-127330 5/1997
JP 2001/341296 12/2001

* cited by examiner

*Primary Examiner*—Manish S. Shah
(74) *Attorney, Agent, or Firm*—Harness, Dickey & Pierce, P.L.C.

(57) ABSTRACT

A liquid droplet ejecting apparatus including a main body, a work carrying table for supporting a work, an Y-directional movement mechanism for moving the work carrying table in the horizontal direction relative to the main body, a droplet ejecting head for ejecting liquid droplets to the work supported by the work carrying table, and at least one blowing unit for blowing a gas towards the work supported by the work carrying table to dry the liquid droplets ejected to the work, wherein the gas has a condition almost equal to the atmosphere in which the liquid droplet ejecting apparatus is placed.

22 Claims, 14 Drawing Sheets

LIQUID DROPLET EJECTING APPARATUS, LIQUID DROPLET EJECTING SYSTEM, ELECTRO-OPTICAL DEVICE, METHOD OF MANUFACTURING ELECTRO-OPTICAL DEVICE, METHOD OF FORMING A METAL WIRING LINE, AND ELECTRONIC APPARATUS

FIELD OF THE INVENTION

The present invention relates to a liquid droplet ejecting apparatus, a liquid droplet ejecting system, an electro-optical device, a method of manufacturing an electro-optical device, a method of forming a metal wiring line, and an electronic apparatus.

DESCRIPTION OF THE RELATED ART

There have been suggested industrial liquid droplet ejecting apparatuses (ink-jet drawing apparatuses) used for manufacturing, for example, color filters of liquid crystal display devices or organic EL (electroluminescence) devices, or for forming metal wiring lines on substrates, by adapting an ink-jet method (a liquid droplet ejecting method) of ink-jet printers.

The liquid droplet ejecting apparatus forms (draws) a predetermined pattern on a work piece by ejecting liquid droplets while relatively moving a work piece carrying table mounted with a work piece such as a substrate and a droplet ejecting head. In a conventional liquid droplet ejecting apparatus, the liquid droplets are ejected on to the work piece, and then the work piece is heated. Thus, the liquid droplets are dried by means of warm air at a temperature of 20° C. or more, or by a lamp that raises a temperature of the heated portion to be higher (30° C. to 200° C.) than room temperature. Thereafter, by ejecting and drying other liquid droplets to the work piece, and ejecting and drying other liquid droplets to the work piece again, color filters are manufactured.

Patterns to be formed (drawn) by means of the liquid droplet ejecting apparatus, used for the aforementioned purpose, require very high accuracy. For this reason, it is preferable that the liquid droplet ejecting apparatus be provided and used in a chamber whose inner atmospheric condition is controlled.

However, in the conventional liquid droplet ejecting apparatus, since a work piece is heated when drying the liquid droplets ejected on to the work piece, the atmosphere (environment) in the chamber is disturbed. Specifically, the environmental temperature is raised and the work piece is thermally expanded. As such, it is difficult to stably form (draw) a pattern with high accuracy.

Therefore, it is desirable to provide a liquid droplet ejecting apparatus and a liquid droplet ejecting system capable of forming (drawing) a pattern from ejected liquid droplets with high accuracy and enhancing throughput (production efficiency), an electro-optical device manufactured by using the liquid droplet ejecting apparatus, a method of manufacturing an electro-optical device by using the liquid droplet ejecting apparatus, a method of forming a metal wiring line by using the liquid droplet ejecting apparatus, and an electronic apparatus comprising the electro-optical device.

SUMMARY OF THE INVENTION

The above desirability is accomplished by the present invention which provides a liquid droplet ejecting apparatus including a main body; a work piece carrying table for supporting a work piece; a Y-directional movement mechanism for moving the work piece carrying table in the horizontal direction (hereinafter, referred to as the "Y-axis direction") relative to the main body; a droplet ejecting head for ejecting liquid droplets to the work piece supported by the work piece carrying table; and at least one blowing unit for blowing a gas towards the work piece supported by the work piece carrying table to dry the liquid droplets ejected to the work piece, wherein the gas has a condition almost equal to the atmosphere in which the liquid droplet ejecting apparatus is placed.

As a result, without disturbing the atmosphere (environment) in which the liquid droplet ejecting apparatus is placed, and in addition, without thermally expanding the work piece, it is possible to dry (preliminarily dry and/or mainly dry) the liquid droplets ejected to the work piece. Accordingly, it is possible to stably form (draw) a pattern from the ejected liquid droplets with high accuracy consistently.

When drying the liquid droplets ejected on to the work piece, the present invention has the following advantages compared with a method of carrying the work piece to a pre-bake furnace and drying the work piece therein.

First, since the liquid droplet ejecting apparatus has a blowing unit, the liquid droplets ejected on to the work piece can be dried in the liquid droplet ejecting apparatus. That is, in a case of alternately and repeatedly performing the ejection of liquid droplets to the work piece and the drying of liquid droplets ejected on to the work piece, when a method of performing the drying operation in a pre-bake furnace is used, a lot of time is taken for supplying and removing a work piece, and an alignment operation is required specifically when the work piece is supplied again to the liquid droplet ejecting apparatus. However, in the present invention, since the drying operation can be performed in the liquid droplet ejecting apparatus, the supply and removal of the work piece or the alignment is not required. As such, it is possible to enhance throughput (production efficiency).

In a case where the liquid droplet ejecting apparatus is provided and used in a chamber whose inner atmospheric condition is controlled, and specifically in a case of alternately and repeatedly performing the ejection of liquid droplets to the work piece and the drying of liquid droplets ejected to the work piece, since the atmosphere (environment) in the chamber is destroyed (supply and removal of a work piece) when the method of performing the drying in a pre-bake furnace is used, time for restoring the destroyed atmosphere to an original condition (an appropriate condition) (for example, when the inside of the chamber is purged with nitrogen, time for purging the chamber with nitrogen again) is required. In the present invention, however, since the drying can be performed in the liquid droplet ejecting apparatus, the atmosphere (environment) in which the liquid droplet ejecting apparatus is placed is not destroyed and it is possible to enhance throughput (production efficiency).

Furthermore, in a case of alternately and repeatedly performing the ejection of liquid droplets to the work piece and drying the liquid droplets ejected to the work piece, since the work piece is heated when the method of performing the drying in a pre-bake furnace is used, time for restoring the work piece to an appropriate temperature (environmental temperature) is required. In the present invention, however, since the drying operation is performed by blowing a gas having almost the same condition as the atmosphere in which the liquid droplet ejecting apparatus is placed, the work piece has the appropriate temperature (environmental temperature) even right after performing the drying, so that next processes can be carried out right after the drying. Therefore, it is possible to enhance throughput (production efficiency).

Further, the method of performing the drying in the pre-bake furnace requires an installing space that is larger than the work piece size for installing the pre-bake furnace outside of the liquid droplet ejecting apparatus. As such, the entire system is enlarged. However, in the present invention, since the liquid droplet ejecting apparatus has the blowing unit, the entire system can be miniaturized.

In the liquid droplet ejecting apparatus according to the present invention, it is preferable that the liquid droplet ejecting apparatus be provided and used in a chamber whose inner atmospheric condition is controlled. As a result, it is possible to form (draw) a pattern from the ejected liquid droplets with high accuracy.

In the liquid droplet ejecting apparatus according to the present invention, it is preferable that when the temperature of the atmosphere in which the liquid droplet ejecting apparatus is placed be set to a, the temperature of the gas to be blown from the blowing unit be a±1° C. As a result, it is possible to form (draw) a pattern from the ejected liquid droplets with high accuracy.

In the liquid droplet ejecting apparatus according to the present invention, it is preferable that when the humidity of the atmosphere in which the liquid droplet ejecting apparatus is placed is set to b, the humidity of the gas to be blown from the blowing unit be b±30%. As a result, it is possible to form (draw) a pattern from the ejected liquid droplets with high accuracy.

In the liquid droplet ejecting apparatus according to the present invention, it is preferable that the kind of gas to be blown from the blowing unit be equal to that of the atmosphere in which the liquid droplet ejecting apparatus is placed. As a result, it is possible to form (draw) a pattern from the ejected liquid droplets with high accuracy.

In the liquid droplet ejecting apparatus according to the present invention, it is preferable that the gas to be blown from the blowing unit be air or an inert gas. As a result, it is possible to obtain a product with a higher quality.

In the liquid droplet ejecting apparatus according to the present invention, it is preferable that the blowing unit has a nozzle formed in a slit shape in the horizontal direction (hereinafter, referred to as the "X-axis direction") perpendicular to the Y-axis direction. As a result, the gas can be blown uniformly in the X-axis direction to the work piece and it is possible to uniformly dry the entire work piece.

In the liquid droplet ejecting apparatus according to the present invention, it is preferable that the blowing unit have opening-width adjusting means for adjusting the width of the opening. As a result, the opening (slit) width of the nozzle can be adjusted to an appropriate value in accordance with various conditions such as the kind of the liquid droplets to be used, the flow rate of the gas to be blown, etc., and it is possible to perform the drying under an appropriate condition.

In the liquid droplet ejecting apparatus according to the present invention, it is preferable that the blowing unit have distance adjusting means for adjusting the distance from the work piece carrying table. As a result, the distance between a work piece surface and the blowing unit can be adjusted into an appropriate value in accordance with various conditions such as the kind of the liquid droplets to be used, the flow rate of the gas to be blown, etc., and it is possible to perform the drying under an appropriate condition.

In the liquid droplet ejecting apparatus according to the present invention, it is preferable that the blowing unit have blowing-angle adjusting means for adjusting the blowing angle (the spraying angle) of the gas to be blown from the blowing unit with respect to the work piece carrying table. As a result, the blowing angle of the gas can be adjusted into an appropriate value in accordance with various conditions such as the kind of the liquid droplets to be used, the flow rate of the gas to be blown, etc., and it is possible to perform the drying under an appropriate condition.

In the liquid droplet ejecting apparatus according to the present invention, it is preferable that the blowing unit have temperature and humidity adjusting means for adjusting a temperature and/or the humidity of the gas to be blown from the blowing unit. As a result, the temperature or humidity of the gas can be adjusted into an appropriate value in accordance with the atmosphere (environment) in which the liquid droplet ejecting apparatus is placed, and it is possible to perform the drying under an appropriate condition.

In the liquid droplet ejecting apparatus according to the present invention, it is preferable that the blowing direction of the gas blown from the blowing unit be toward an opposite side of the droplet ejecting head. As a result, even when the drying is performed while ejecting the liquid droplets to the work piece, the ejection of liquid droplets is not influenced by the gas to be blown to the work piece, so that it is possible to form (draw) a pattern from the ejected liquid droplets with high accuracy.

In the liquid droplet ejecting apparatus according to the present invention, it is preferable that the blowing unit be provided in the main body. As a result, when the liquid droplets ejected to the work piece is dried, the work piece supported by the work piece carrying table is moved in the Y-axis direction relative to the blowing unit by moving the work piece carrying table in the Y-axis direction, so that it is possible to surely dry the entire work piece.

In the liquid droplet ejecting apparatus according to the present invention, it is preferable that two blowing units be provided, respectively, at two positions separated in the Y-axis direction from each other, with the droplet ejecting head therebetween. As a result, it is possible to miniaturize the liquid droplet ejecting apparatus, and specifically to lessen its Y-directional length.

In the liquid droplet ejecting apparatus according to the present invention, it is preferable that one of the two blowing units be made to dry a part of the work piece, and the other be made to dry at least the remainder of the work piece. As a result, it is possible to miniaturize the liquid droplet ejecting apparatus, and specifically to lessen its Y-directional length.

In the liquid droplet ejecting apparatus according to the present invention, it is preferable that the liquid droplets ejected to the work piece be dried by moving the work piece carrying table in the Y-axis direction while allowing the blowing unit to blow the gas. As a result, it is possible to surely dry the entire work piece, regardless of the size of the work piece.

In the liquid droplet ejecting apparatus according to the present invention, it is preferable that a predetermined pattern be formed on the work piece by allowing the droplet ejecting head to eject the liquid droplets while relatively moving the work piece carrying table and the droplet ejecting head. As a result, various kinds of patterns can be formed (drawn) on the work piece in accordance with their purposes.

It is preferable that the liquid droplet ejecting apparatus according to the present invention further comprise an X-directional movement mechanism for moving the droplet ejecting head in the horizontal direction (hereinafter, referred to as the "X-axis direction") perpendicular to the Y-axis direction, relative to the main body. As a result, various kinds of patterns can be formed (drawn) on the work piece in accordance with their purposes.

In the liquid droplet ejecting apparatus according to the present invention, it is preferable that the liquid droplets be ejected to the work piece from the droplet ejecting head while relatively moving the work piece carrying table and the droplet ejecting head by using one of the Y-axis direction and the X-axis direction as the primary scanning direction and the other as the secondary scanning direction. As a result, various kinds of patterns can be formed (drawn) on the work piece in accordance with their purposes.

In the liquid droplet ejecting apparatus according to the present invention, it is preferable that the liquid droplets be ejected to the work piece from the droplet ejecting head while relatively moving the work piece carrying table and the droplet ejecting head by using the Y-axis direction as the primary scanning direction and the X-axis direction as the secondary scanning direction. As a result, various kinds of patterns can be formed (drawn) on the work piece in accordance with their purposes.

In the liquid droplet ejecting apparatus according to the present invention, it is preferable that the liquid droplet ejecting apparatus form a metal wiring line on the work piece. As a result, it is possible to obtain a product of high quality in which a metal wiring line pattern is formed (drawn) with high accuracy.

A liquid droplet ejecting system according to the present invention comprises the liquid droplet ejecting apparatus according to the present invention, and a chamber for housing the liquid droplet ejecting apparatus, wherein the inner atmospheric condition of the chamber is controlled. As a result, it is possible to form (draw) a pattern from the ejected liquid droplets with higher accuracy.

It is preferable that the liquid droplet ejecting system according to the present invention further comprise an air conditioning apparatus for adjusting a temperature and/or a humidity in the chamber. As a result, it is possible to form (draw) a pattern from the ejected liquid droplets with higher accuracy.

An electro-optical device according to the present invention is manufactured by using the liquid droplet ejecting apparatus according to the present invention. As a result, it is possible to provide an electro-optical device comprising a high-performance component in which a pattern is formed (drawn) with high accuracy and having low manufacturing cost.

A method of manufacturing an electro-optical device according to the present invention uses the liquid droplet ejecting apparatus according to the present invention. As a result, it is possible to provide a method of manufacturing an electro-optical device, wherein a pattern can be formed (drawn) on a work piece with high accuracy and the manufacturing cost can be reduced.

In a method of forming a metal wiring line according to the present invention, the metal wiring line is formed on the work piece by using the liquid droplet ejecting apparatus according to the present invention. As a result, it is possible to provide a method of forming a metal wiring line, wherein a metal wiring line pattern can be formed (drawn) on a work piece with high accuracy and the manufacturing cost can be reduced.

An electronic apparatus according to the present invention comprises the electro-optical device according to the present invention. As a result, it is possible to provide an electronic apparatus comprising a high-performance component in which a pattern is formed (drawn) with high accuracy and having low manufacturing cost.

DETAILED DESCRIPTION OF THE PREFERRED EMBODIMENTS

Now, a liquid droplet ejecting apparatus and a liquid droplet ejecting system according to the present invention will be described in detail in conjunction with preferred embodiments shown in the accompanying drawings.

Figure 1:
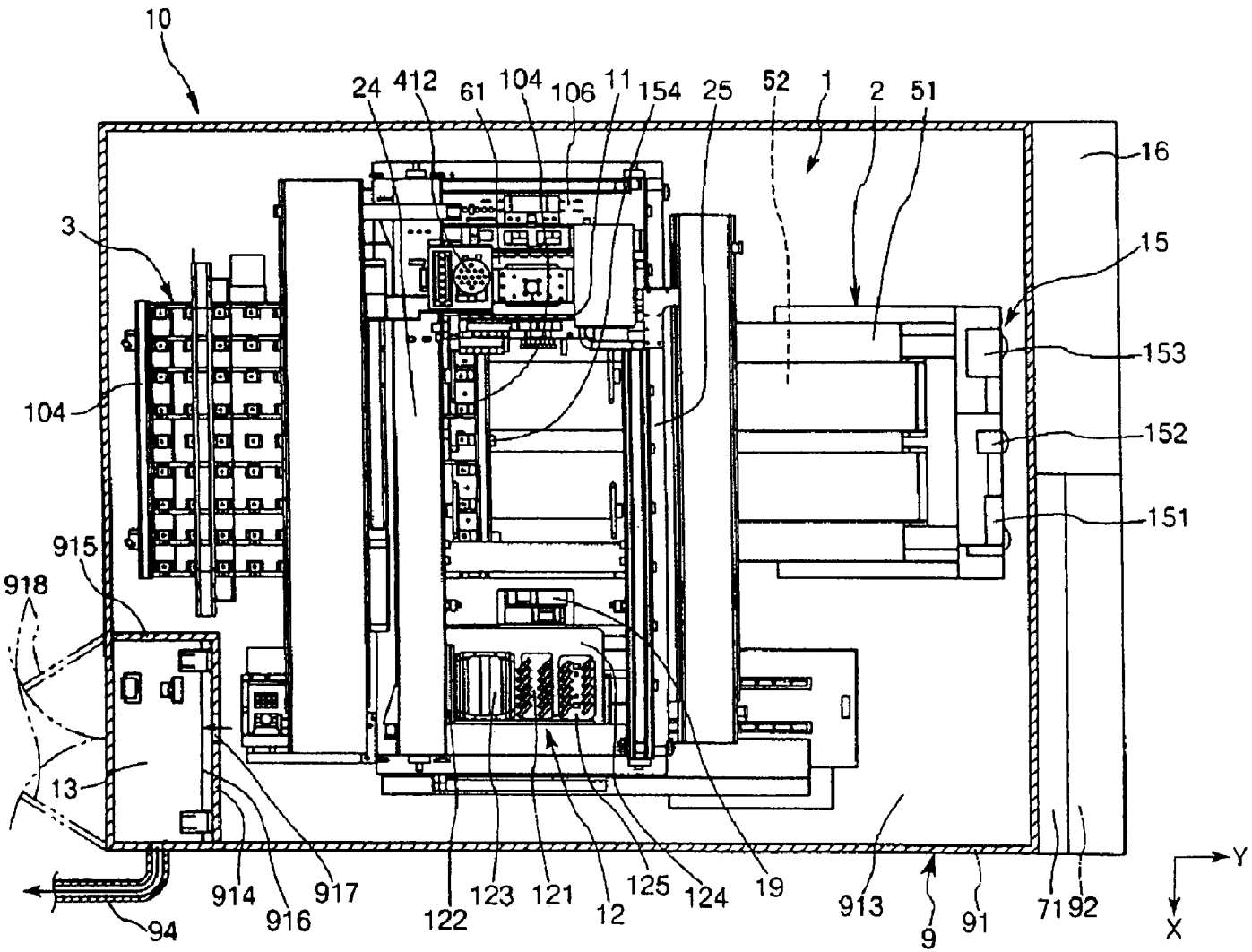
FIG. 1 is a plan view illustrating an embodiment of a liquid droplet ejecting apparatus according to a principle of the present invention.
Figure 2:
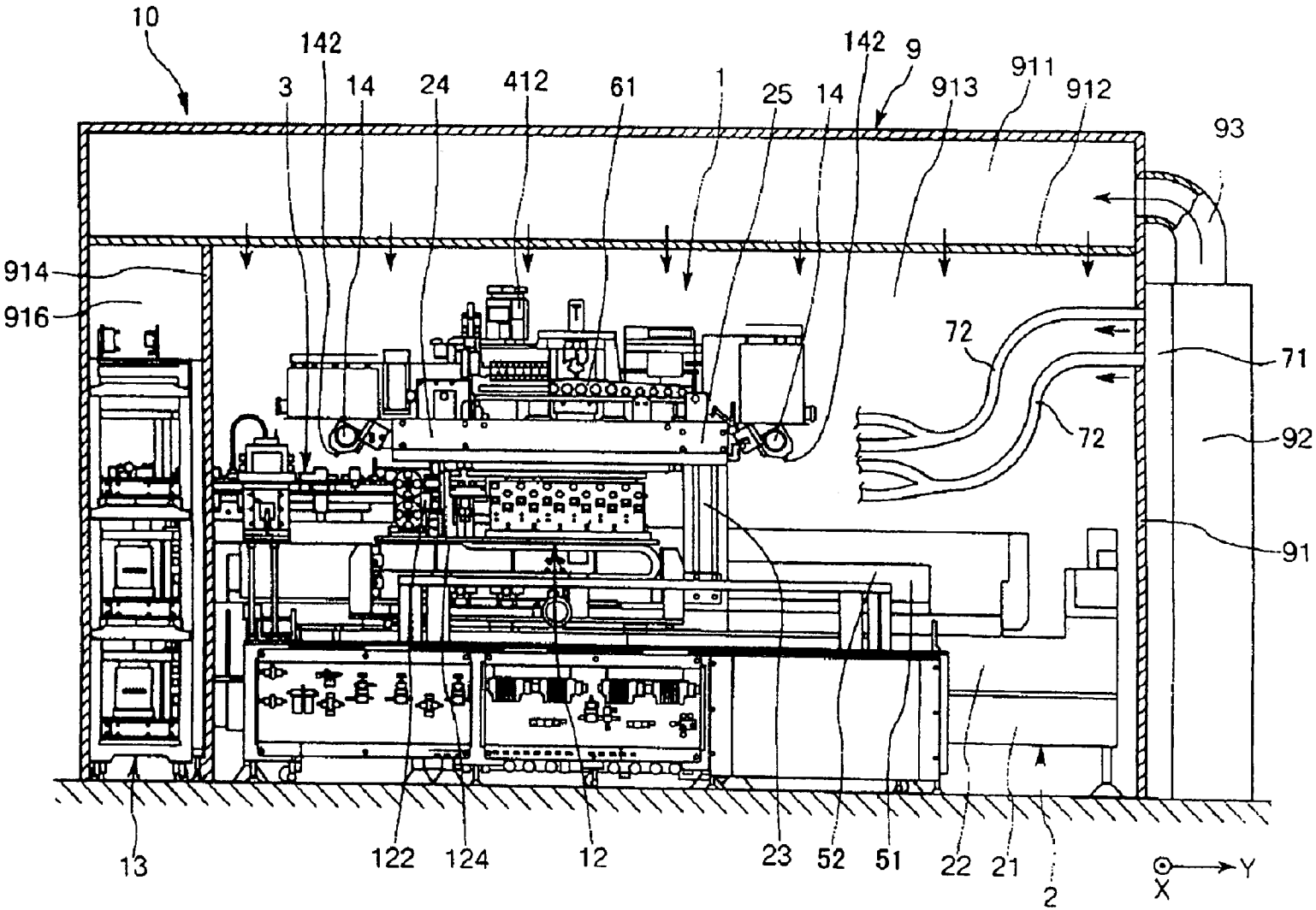
FIG. 2 is a side view illustrating an embodiment of a liquid droplet ejecting apparatus according to a principle of the present invention.

FIGS. 1 and 2 are a plan view and a side view illustrating an embodiment of a liquid droplet ejecting apparatus and a liquid droplet ejecting system according to the present invention, respectively. Hereinafter, for the purpose of convenient explanation, one horizontal direction (the direction corresponding to the right-left direction in FIGS. 1 and 2) is referred to as the "Y-axis direction", and another horizontal direction (the direction corresponding to the up-down direction in FIG. 1) perpendicular to the Y-axis direction is referred to as the "X-axis direction". Further, in the Y-axis direction, movement to the right in FIGS. 1 and 2 is referred to as "Y-axis advance", and movement to the left in FIGS. 1 and 2 is referred to as "Y-axis retreat". Furthermore, in the X-axis direction, downward movement in FIG. 1 is referred to as "X-axis advance", and upward movement in FIG. 1 is referred to as "X-axis retreat".

A liquid droplet ejecting system 10 shown in FIGS. 1 and 2 comprises a liquid droplet ejecting apparatus (an ink-jet drawing apparatus) 1 having liquid droplet ejecting heads 111, and a chamber 91 for housing the liquid droplet ejecting apparatus 1.

The liquid droplet ejecting apparatus 1 is an apparatus for ejecting a liquid (an ejection liquid) such as ink, a functional liquid containing target materials, etc. in a fine liquid droplet state to a substrate W as a work piece by using an ink-jet method (a liquid droplet ejecting method) to form (draw) a predetermined pattern. The liquid droplet ejecting apparatus 1 can be used for manufacturing an organic EL display device or a color filter of a liquid crystal display device, or for forming metal wiring lines on a substrate. Its use is not particularly limited, but it is preferable that it be used for forming metal wiring lines. A material of the substrate W, which is an objective of the liquid droplet ejecting apparatus 1, is not particularly limited, and the substrate may include any plate-shaped member such as a glass substrate, a silicon substrate, a flexible substrate, etc.

In addition, the work piece, which is an objective in the present invention, is not limited to the plate-shaped member, but may include any member having a flat bottom surface. For example, the present invention can be applied to a liquid droplet ejecting apparatus, etc. for forming a coating film such as an optical thin film by using a lens as a work piece and ejecting liquid droplets to the lens. The present invention can be applied particularly to a relatively large liquid droplet ejecting apparatus 1 which can cope with a relatively large work piece (for example, a work piece having a length and a width in the range of several tens of centimeters through several meters).

The liquid droplet ejecting apparatus 1 comprises a main body 2, a substrate carrying table (a substrate carrying stage) 3 as a work piece carrying table (a work piece carrying stage), a head unit 11 having a plurality of droplet ejecting heads (ink-jet heads) 111, a maintenance apparatus 12 for performing maintenance of the droplet ejecting heads 111, a tank unit 13 having a liquid supply tank, a discharged liquid tank and a reuse tank, a blowing unit 14 for emitting a gas to a substrate W, a length measuring laser unit 15 for measuring a moved length of the substrate carrying table 3, a control unit 16, and a dot omission detecting unit 19.

The ejection liquid to be ejected from the droplet ejecting heads 111 is not particularly limited, and in addition to an ink containing filter materials for a color filter, it may include a liquid (including a dispersed liquid such as a suspension, an emulsion, etc.) containing, for example, the following various materials: a light emitting material for forming an EL light emitting layer in an organic EL (electroluminescence) device; a fluorescent material for forming a fluorescent layer on an electrode in an electron emitting device; a fluorescent material for forming a fluorescent layer in a PDP (Plasma Display Panel) device; an electrophoretic material for forming an electrophoretic layer in an electrophoresis display device; a bank material for forming a bank on a surface of a substrate W; various kinds of coating materials; a liquid-state electrode material for forming an electrode; a particle material for forming a spacer for forming a fine cell gap between two sheets of substrates; a liquid-state metal material for forming a metal wiring line; a lens material for forming a micro lens; a resist material; and a light diffusing material for forming a light diffusing layer.

As shown in FIG. 2, the main body 2 has a trestle 21 provided on a floor, and a stone surface plate 22 provided on the trestle 21. The substrate carrying table 3 is provided on the stone surface plate 22 to be movable in the Y-axis direction with respect to the main body 2. The substrate carrying table 3 advances and retreats in the Y-axis direction by means of driving a linear motor 51. The substrate W is mounted on the substrate carrying table 3.

The liquid droplet ejecting apparatus 1 may use, as an objective of the present invention, substrates W having various sizes and shapes, which may include substrates W ranging from a relatively large substrate W having the same size as the substrate carrying table 3 to a relatively small substrate W that is smaller than the substrate carrying table 3. It is generally preferable that the liquid droplet ejecting operation be performed in a state where centers of the substrate W and the substrate carrying table 3 are positioned at the same position. In a case of the relatively small substrates W, however, the liquid droplet ejecting operation be performed in a state where the substrates W are positioned closely to the edge portions of the substrate carrying table 3.

As shown in FIG. 1, in the vicinities of two sides along the X-axis direction of the substrate carrying table 3, a before-drawing flushing unit 104 for receiving ejection liquid droplets wastefully ejected (flushed) from the droplet ejecting heads 111 before ejection of the liquid droplets (drawing) to the substrate W is provided. Suction tubes (not shown) are connected to the before-drawing flushing unit 104, and the ejection liquid wastefully ejected is recovered through the suction tubes and stored in the discharged liquid tank provided in the tank unit 13.

The moved length of the substrate carrying table 3 in the Y-axis direction is measured by the length measuring laser unit 15 as a moved length detecting means. The length measuring laser unit 15 has a length measuring laser sensor head 151, a prism 152 and a length measuring laser unit body 153 provided at the main body 2, and a corner cube 154 provided at the substrate carrying table 3. A laser ray emitted from the length measuring laser sensor head 151 in the X-axis direction is bent by the prism 152, advances in the Y-axis direction, and is applied to the corner cube 154. The reflected ray from the corner cube 154 is restored to the length measuring laser sensor head 151 via the prism 152. In the liquid droplet ejecting apparatus 1, on the basis of the moved length (current position) of the substrate carrying table 3 detected by the length measuring laser unit 15, the ejecting timing from the droplet ejecting heads 111 is generated.

In addition, a main carriage 61 supporting the head unit 11 is provided in the main body 2 to be movable in the X-axis direction in a space above the substrate carrying table 3. The head unit 11 having a plurality of droplet ejecting heads 111 advances and retreats in the X-axis direction together with the main carriage 61 by driving a linear motor actuator 62 comprising a linear motor and a guide.

In a so-called primary scanning of the droplet ejecting heads 111 in the liquid droplet ejecting apparatus 1 according to the present invention, the droplet ejecting heads 111 are driven (the liquid droplets are selectively ejected) while moving the substrate carrying table 3 in the Y-axis direction, on the basis of the ejecting timing generated using the length measuring laser unit 15. Correspondingly thereto, a so-called secondary scanning is performed by means of movement of the head unit 11 (the droplet ejecting heads 111) in the X-axis direction.

In addition, the main body 2 is provided with the blowing unit 14 for blowing a gas towards the substrate W supported by the substrate carrying table 3 to dry (preliminarily dry (semi-dry) and/or mainly dry) the liquid droplets ejected to the substrate W, wherein the gas has almost the same condition as the atmosphere in which the liquid droplet ejecting apparatus 1 is placed. The blowing unit 14 will be described later in detail.

The maintenance apparatus 12 is provided at side portions of the trestle 21 and the stone surface plate 22. The maintenance apparatus 12 has a capping unit 121 for capping the droplet ejecting heads 111 during the wait time of the head unit 11, a cleaning unit 122 for wiping the nozzle formed surfaces of the droplet ejecting heads 111, a regular flushing unit 123 subjected to the regular flushing of the droplet ejecting heads 111, and a weight measuring unit 125.

The maintenance apparatus 12 has a movable platen 124 which can be moved in the Y-axis direction, and a capping unit 121, a cleaning unit 122, a regular flushing unit 123 and a weight measuring unit 125 are arranged in a line in the Y-axis direction on the movable platen 124. By moving the movable platen 124 in the Y-axis direction in a state where the head unit 11 is moved above the maintenance apparatus 12, any one of the capping unit 121, the cleaning unit 122, the regular flushing unit 123 and the weight measuring unit 125 can be positioned below the droplet ejecting heads 111. During the wait time, the head unit 11 is moved above the maintenance apparatus 12, and then performs the capping, the cleaning (wiping) and the regular flushing in a predetermined order.

The capping unit 121 has a plurality of caps arranged correspondingly to the plurality of droplet ejecting heads 111, respectively, and a hoisting mechanism for hoisting the caps. A suction tube (not shown) is connected to each cap, and the capping unit 121 can cover the nozzle formed surfaces of the droplet ejecting heads 111 with the caps and suck the ejection liquid from the nozzles formed in the nozzle formed surfaces. By performing the capping, it is possible to prevent the nozzle formed surfaces of the droplet ejecting heads 111 from being dried, or to release (solve) the nozzle clogging.

The capping of the capping unit 121 is performed when the head unit 11 lies in a wait state, when the head unit 11 is initially filled with the ejection liquid, when the ejection liquid is discharged from the head unit 11 for replacing the ejection liquid with a different kind of liquid, or when the flow paths are cleaned with the cleaning solution, etc.

The ejection liquid discharged from the droplet ejecting heads 111 during the capping by the capping unit 121 is introduced into the reuse tank provided in the tank unit 13 through the suction tubes, and is stored therein. This stored liquid is recovered and reused. However, the cleaning solution recovered when cleaning the flow paths is not reused.

The cleaning unit 122 allows the wiping sheet containing the cleaning solution to travel by means of a roller, and wipes and cleans the nozzle formed surfaces of the droplet ejecting heads 111 with the wiping sheet.

The regular flushing unit 123 is used for the flushing during the wait time of the head unit 11, and receives the ejection liquid droplets wastefully ejected by the droplet ejecting heads 111. The regular flushing unit 123 is connected to suction tubes (not shown), and the ejection liquid wastefully ejected is recovered through the suction tubes and is stored in a discharged liquid tank provided in the tank unit 13.

The weight measuring unit 125 is used for measuring an ejection amount (weight) of the liquid droplets ejected one time from the droplet ejecting heads 111 as a preliminary step for ejecting the liquid droplets to the substrate W. That is, before the ejection of the liquid droplets to the substrate W, the head unit 11 is moved above the weight measuring unit 125, and ejects one or more times the liquid droplets to the weight measuring unit 125 from all of the ejection nozzles of the respective droplet ejecting heads 111. The weight measuring unit 125 comprises liquid receivers for receiving the ejected liquid droplets and a scale such as an electronic scale, and measures a weight of the ejected liquid droplets. Alternatively, the liquid receivers may be separated and their weights may be measured by an external scale. The control unit 16, to be described later, calculates the amount (weight) of the liquid droplets ejected one time from the ejection nozzles on the basis of the weight measuring result, and corrects the voltage applied to a head driver for driving the droplet ejecting heads 111 such that the calculated value is equal to a predetermined design value.

The dot omission detecting unit 19 is fixedly provided at a position which is not superposed with the moving area of the substrate carrying table 3 on the stone surface plate 22 and which is below a moving area of the head unit 11. The dot omission detecting unit 19 performs a dot omission inspection resulting from a nozzle clogging of the droplet ejecting heads 111, and comprises, for example, a light emitting portion and a light receiving portion for emitting and receiving a laser ray, respectively.

When the dot omission inspection is performed, the liquid droplets are wastefully ejected from the respective ejecting nozzles while moving the head unit 11 in the X-axis direction in a space above the dot omission detecting unit 19, and the dot omission detecting unit 19 performs the light emitting/receiving operation on the wastefully ejected liquid droplets to optically detect the clogging of the ejecting nozzles and their positions. At this time, the ejection liquid ejected from the droplet ejecting head 111 is received by trays provided in the dot omission inspecting unit 19, recovered through the suction tubes (not shown) connected to bottoms of the tray, and is stored in a discharged liquid tank provided in the tank unit 13.

The tank unit 13 is provided with a liquid supply tank for storing the ejection liquid to be supplied to the droplet ejecting heads 111, a solution supply tank for storing the cleaning solution to be supplied to the cleaning unit 122, etc., in addition to the reuse tank for storing the ejection liquid recovered in the aforementioned capping, a discharged liquid tank for storing the ejection liquid recovered in the before-drawing flushing, the regular flushing and the dot omission inspection. The insides of the liquid supply tanks are pressurized with a pressurizing gas such as nitrogen gas supplied from a pressurizing gas supply source (not shown) provided in the vicinity of the liquid droplet ejecting apparatus 1 (preferably, outside the chamber 91 to be described later), and the ejection liquid and the cleaning solution flow out by means of the pressure.

The control unit (control means) 16 controls the operation of each element of the liquid droplet ejecting apparatus 1, and has a CPU (Central Processing Unit) and a memory unit for storing various programs such as programs for executing control operation of the liquid droplet ejecting apparatus 1 and various data. In the illustrated configuration, the control unit 16 is provided outside a chamber 91 to be described later.

The liquid droplet ejecting apparatus 1 (excluding the control unit 16) is preferably placed under an environment whose atmospheric conditions such as a temperature and a humidity are controlled by the chamber unit 9. The chamber unit 9 has a chamber 91 for housing the liquid droplet ejecting apparatus 1, and an air conditioning system 92 provided outside the chamber 91. The air conditioning system 92 has, for example, a known air conditioner therein, and generates an air (adjusted air) whose temperature and humidity have been adjusted. The adjusted air is sent to a space 911 under the roof of the chamber 91 through an inlet duct 93. The adjusted air is introduced into a main chamber 913 of the chamber 91 through a filter 912 from the space 911 under the roof.

In the chamber 91, an auxiliary chamber 916 is formed by means of partition walls 914, 915, and the tank unit 13 is provided in the auxiliary chamber 916. A communicating portion (passage) 917 allowing the main chamber 913 to communicate with the auxiliary chamber 916 is formed in the partition wall 914.

The auxiliary chamber 916 is provided with an opening and closing door (an opening and closing portion) 918 to the outside of the chamber 91 (see FIG. 1). The opening and closing portion of the auxiliary chamber 916 is not limited to a hinged door such as the opening and closing door 918, and may be a sliding door, a shutter, etc.

A discharging outlet for discharging gas in the auxiliary chamber 916 is formed in the auxiliary chamber 916, and an outlet duct 94 extending outwardly is connected to the discharging outlet. The adjusted air introduced into the main chamber 913 flows in the auxiliary chamber 916 through the communicating portion 917, and then is discharged to the outside of the chamber unit 9 through the outlet duct 94.

Since the temperature and the humidity around the liquid droplet ejecting apparatus 1 are controlled by means of the chamber unit 9, it is possible to prevent errors resulting from expansion and contraction of the respective elements or the substrate W due to variation in temperature, so that it is possible to draw (form) a pattern on the substrate W from the ejection liquid droplets with high accuracy. Further, since the tank unit 13 is also put in an environment whose temperature and humidity are controlled, a viscosity, etc. of the ejection liquid is stabilized, so that it is possible to form (draw) a pattern from the ejection liquid droplets with higher accuracy. Since the infiltration of dust, etc. into the chamber 91 can be prevented, it is possible to keep the substrate W clear.

A gas other than an air (for example, an inert gas such as nitrogen, carbon dioxide, helium, neon, argon, krypton, xenon, radon, etc.) whose temperature and humidity have been adjusted may be supplied and filled in the chamber 91, and then in the atmosphere of the above gas, the liquid droplet ejecting apparatus 1 may be operated. In this case, the substrate W is dried by allowing the blowing unit 14 described later to blow a gas (for example, an inert gas such as nitrogen, carbon dioxide, helium, neon, argon, krypton, xenon, radon, etc.) of the same kind as the atmosphere in the chamber 91.

In the liquid droplet ejecting system 10, the tank unit 13 can be accessed without exposing the main chamber 913 to the outside by opening the opening and closing door 918. As a result, since the controlled temperature and humidity around (environment) the liquid droplet ejecting apparatus 1 are not disturbed in accessing the tank unit 13, it is possible to form (draw) a pattern with high accuracy even right after performing the replacement of the tanks, or the fill-up or recovery of the liquid. Since it is not necessary to wait until the temperature in the main chamber 913 or the temperatures of the elements of the liquid droplet ejecting apparatus 1 are restored to a controlled value after performing the replacement of the tanks, or the fill-up or recovery of the liquid, it is possible to enhance throughput (production efficiency). As a result, it is very advantageous for mass-producing work pieces such as substrates W with high accuracy, and thus it is possible to reduce the manufacturing cost.

Figure 3:
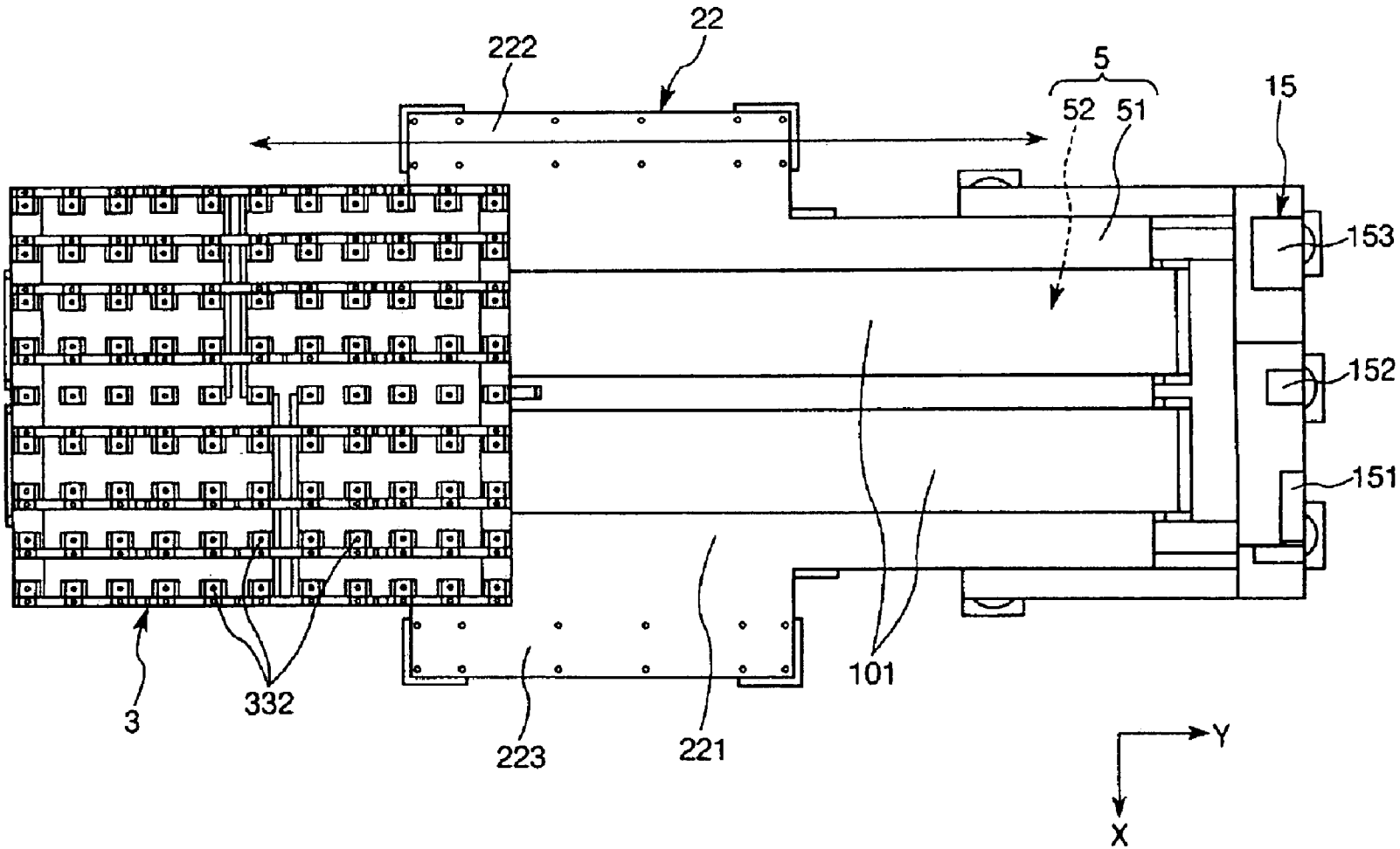
FIG. 3 is a plan view illustrating a trestle, a stone surface plate and a substrate carrying table according to a principle of the present invention.
Figure 4:
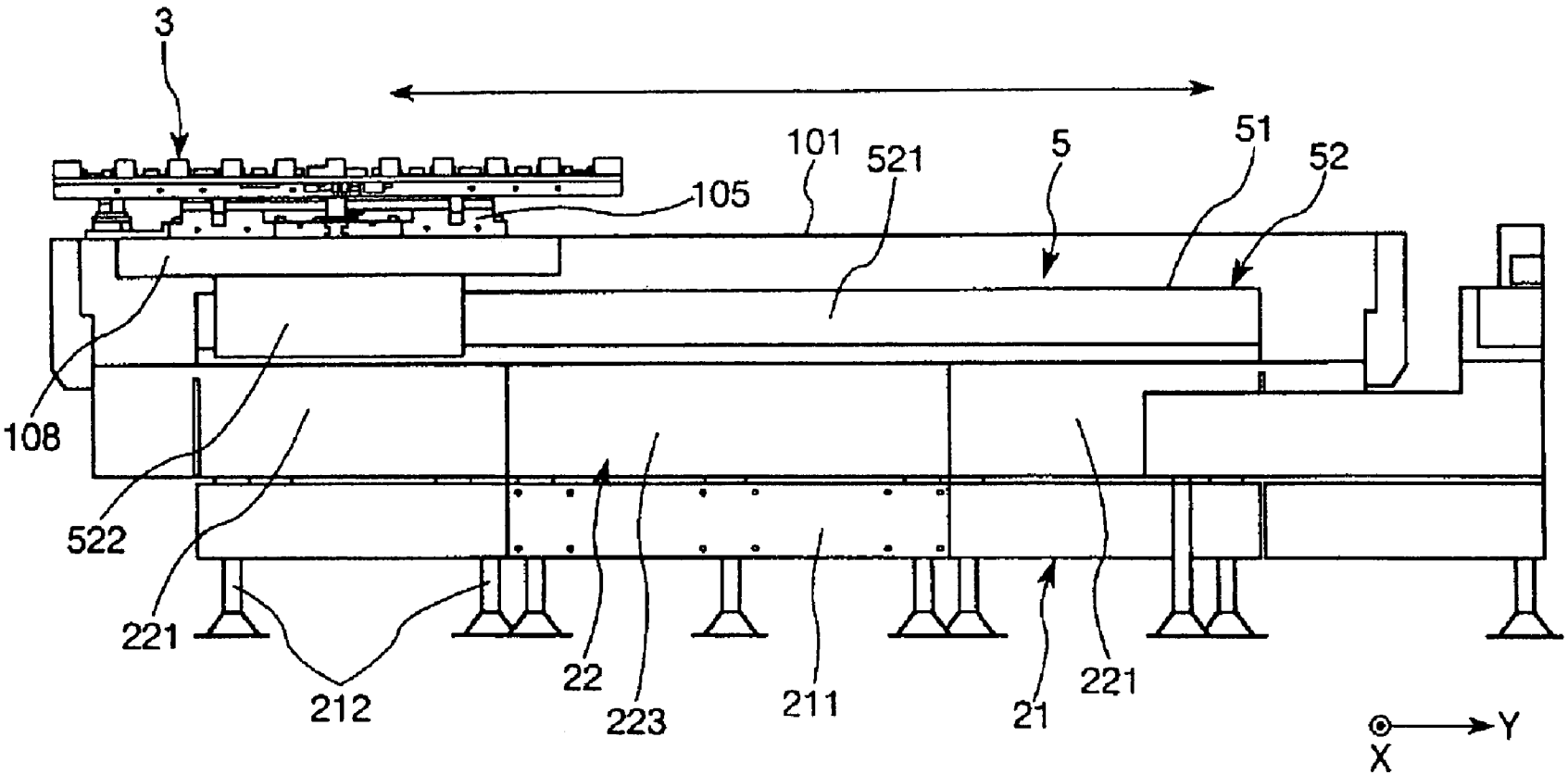
FIG. 4 is a side view illustrating the trestle, the stone surface plate and the substrate carrying table according to a principle of the present invention.

FIG. 3 is a plan view illustrating the trestle, the stone surface plate and the substrate carrying table in the liquid droplet ejecting apparatus shown in FIGS. 1 and 2, and FIG. 4 is a side view illustrating the trestle, the stone surface plate and the substrate carrying table in the liquid droplet ejecting apparatus shown in FIGS. 1 and 2.

As shown in FIGS. 3 and 4, the substrate carrying table 3 and the Y-directional movement mechanism 5 for moving the substrate carrying table 3 in the Y-axis direction are provided on the stone surface plate 22. As shown in FIG. 3, a plurality of suction holes (suctioning portions) 332 for suctioning and fixing the mounted substrate W are formed in the substrate carrying table 3.

As shown in FIG. 4, the Y-directional movement mechanism 5 has a linear motor 51 and an air slider 52. The air slider 52 has a slide guide 521 extending in the Y-axis direction on the stone surface plate 22 and a slide block 522 movable along the slide guide 521. The slide block 522 has an air emitting port for emitting air between the slide block and the slide guide 521, and can be smoothly moved by interposing the air emitted from the air emitting port between the slide block and the slide guide 521.

A base 108 is fixed onto the slide block 522, and the substrate carrying table 3 is fixed onto the base 108 with a θ axial rotation mechanism 105 therebetween. In this way, the substrate carrying table 3 is supported by the air slider 52 to be smoothly movable in the Y-axis direction, and can be moved in the Y-axis direction by means of operation of the linear motor 51. The substrate carrying table 3 is rotatable within a predetermined range about the vertical θ axis passing through the center of the substrate carrying table 3 by means of the θ axial rotation mechanism 105.

Above the Y-directional movement mechanism 5, a pair of band-shaped thin plates 101 made of a metal material such as stainless steel are provided to cover the Y-directional movement mechanism 5 from the upper side. The thin plates 101 pass through a concave portion (a groove) formed in the upper surface of the base 108, and are inserted between the base 108 and the θ axial rotation mechanism 105. The ejection liquid ejected from the droplet ejecting heads 111 can be prevented from being attached to the Y-directional movement mechanism 5 by providing the thin plates 101, thereby protecting the Y-directional movement mechanism 5.

The stone surface plate 22 is formed from immaculate stone, and its upper surface has high flatness. The stone surface plate 22 is excellent in various characteristics such its stability against variation in environmental temperature, its attenuation characteristic against vibration, its stability against secular variation (deterioration), and its corrosion resistance against the ejection liquid. In the present invention, by allowing the Y-directional movement mechanism 5 and the X-directional movement mechanism 6 described later to be supported by the stone surface plate 22, errors due to the variation in an environmental temperature and the vibration and the secular variation (deterioration) are small. Further, the relative movement of the substrate carrying table 3 and the head unit 11 (the droplet ejecting heads 111) can be performed with high accuracy, and the high accuracy can be always stably maintained. As a result, it is possible to stably form (draw) a pattern from the ejected liquid droplets with higher accuracy consistently.

The stone material forming the stone surface plate 22 is not particularly limited, and may be preferably any one of Belfast Black, Rustenberg, Kurnool, and Indian Black. Accordingly, the aforementioned characteristics of the stone surface plate 22 can be further improved.

The stone surface plate 22 is supported by the trestle 21. The trestle 21 has a frame 211 formed in a square shape out of angle, etc., and a plurality of support legs 212 distributed and arranged under the frame 211. Preferably, the trestle 21 has a vibration-proof structure employing an air spring or a rubber bush, so that vibration from the floor can be prevented from being transferred to the stone surface plate 22.

In addition, the stone surface plate 22 is preferably supported by (mounted on) the trestle 21 in a state not coupled (not fixed) to the trestle 21. As a result, it is possible to avoid influence of heat expansion, etc. generated in the trestle 21 on the stone surface plate 22. As such, it is possible to form (draw) a pattern from the ejection liquid droplets with higher accuracy.

Figure 5:
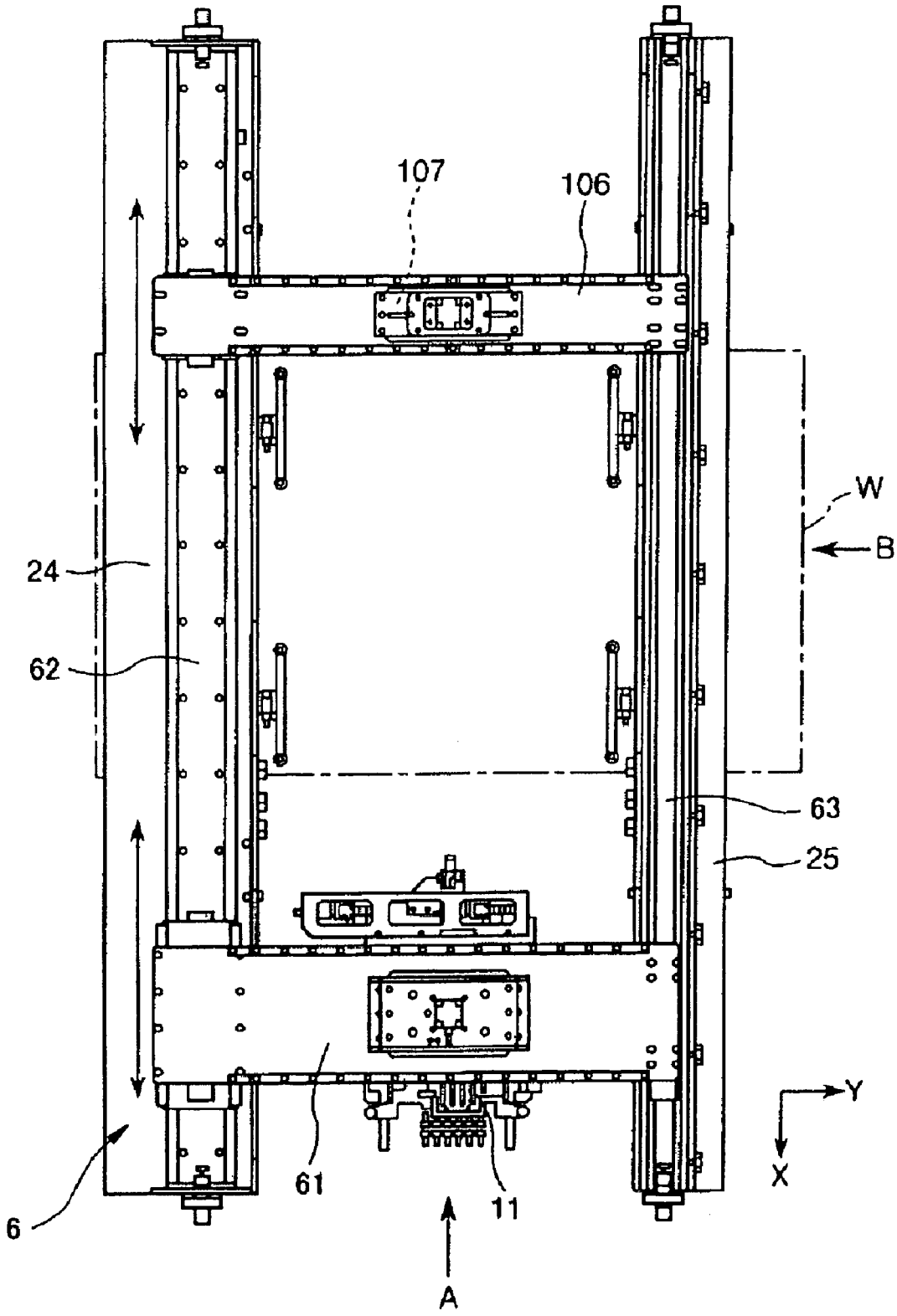
FIG. 5 is a plan view illustrating a head unit and an X-axis movement mechanism according to a principle of the present invention.
Figure 6:
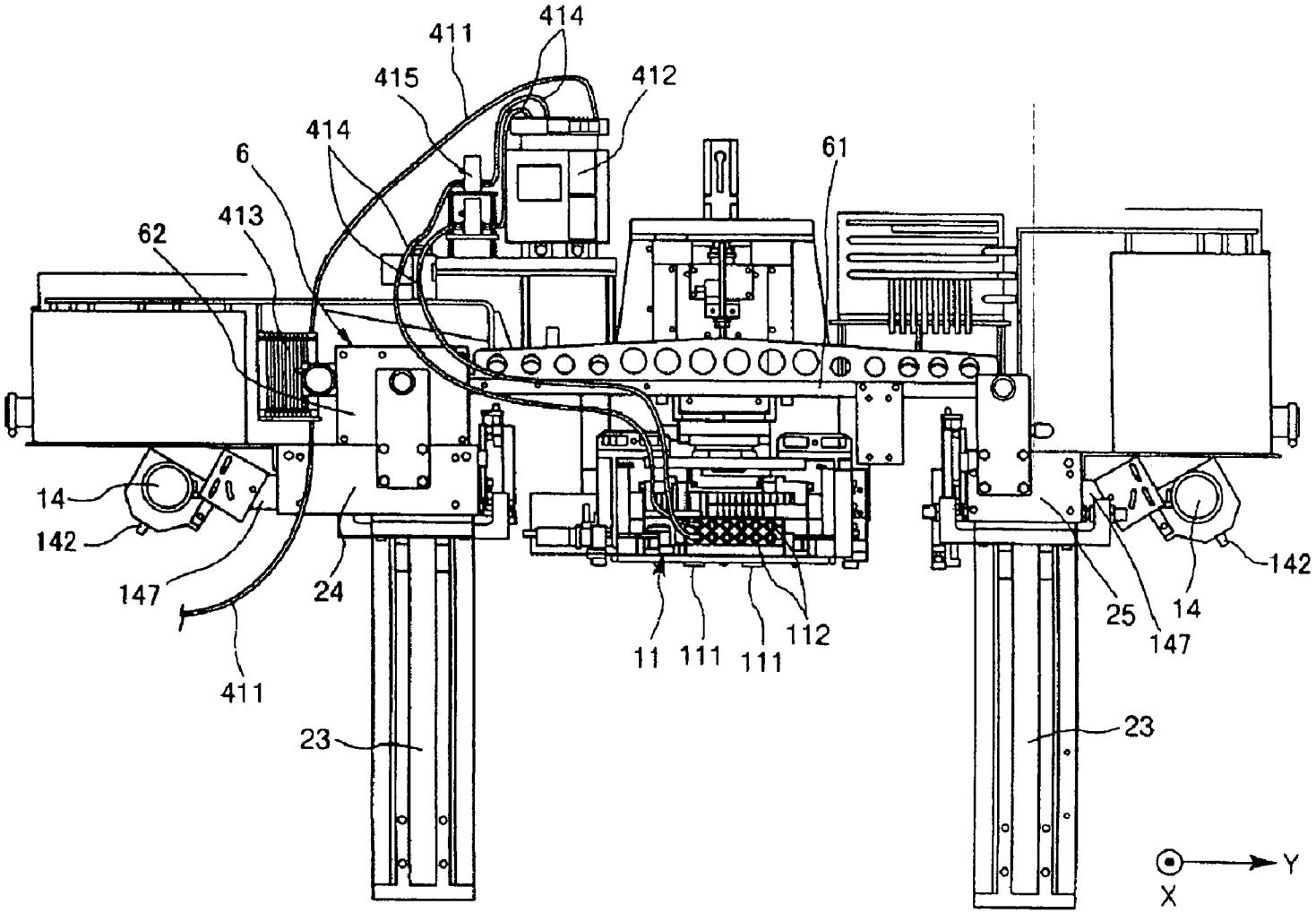
FIG. 6 is a side view seen from an arrow A in FIG. 5.
Figure 7:
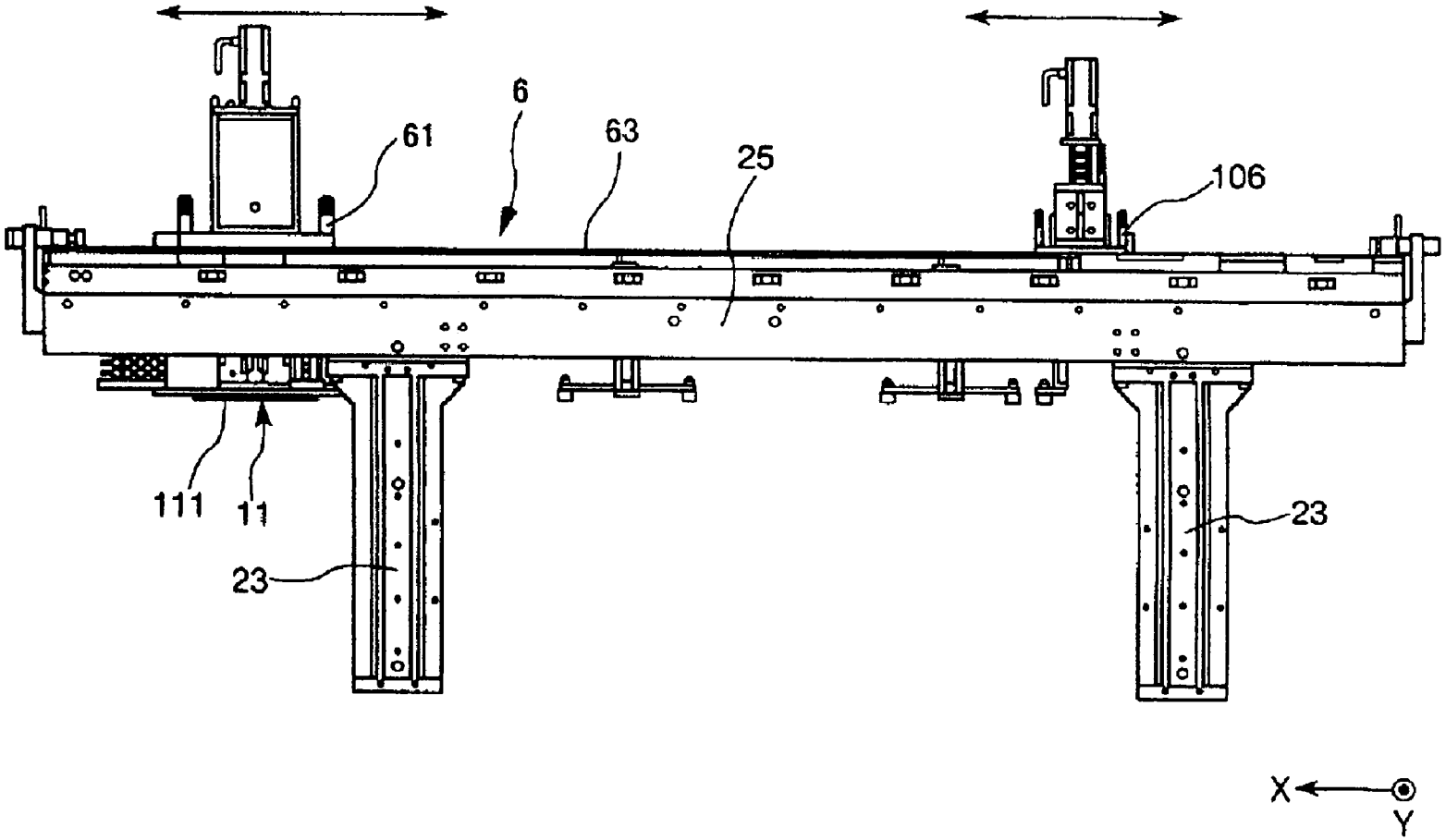
FIG. 7 is a front view seen from an arrow B in FIG. 5.

FIG. 5 is a plan view illustrating the head unit and the X-axis movement mechanism in the liquid droplet ejecting apparatus shown in FIGS. 1 and 2. FIG. 6 is a side view as seen from an arrow A in FIG. 5. FIG. 7 is a front view as seen from an arrow B in FIG. 5.

As shown in FIGS. 6 and 7, four pillars 23, and two parallel bars 24 and 25 extending in the X-axis direction and supported by the four pillars 23 are provided on the stone surface plate 22. The substrate carrying table 3 can pass below the bars 24 and 25.

The X-directional movement mechanism 6 for moving the droplet ejecting heads 111 (the head unit 11) in the X-axis direction is supported through the bars 24 and 25 by the four pillars 23. As shown in FIG. 5, the X-directional movement mechanism 6 has a main carriage (a head unit support) 61 for supporting the head unit 11, a linear motor actuator 62 which is provided on the bar 24 and guides and drives the main carriage 61 in the X-axis direction, and a guide 63 which is provided on the bar 25 and guides the main carriage 61 in the X-axis direction. The main carriage 61 is laid over the linear motor actuator 62 and the guide 63.

The head unit 11 is detachably supported by the main carriage 61. By moving the head unit 11 together with the main carriage 61 in the X-axis direction, the secondary scanning of the droplet ejecting heads 111 is performed.

A camera carriage 106 is laid over the linear motor actuator 62 and the guide 63. The camera carriage 106 shares the linear motor actuator 62 and the guide 63 with the main carriage 61, and is moved in the X-axis direction independently from the main carriage 61.

A recognition camera 107 for recognizing images of alignment marks formed at predetermined positions of the substrate W is provided in the camera carriage 106. The recognition camera 107 is suspended downwardly from the camera carriage 106. The recognition camera 107 may be used for other purposes.

As shown in FIG. 6, a secondary tank 412 is provided on the main carriage 61, and the secondary tank 412 is connected to a liquid supply pipe 411 extending from the liquid supply tank which is provided in the tank unit 13 and stores the ejection liquid. The liquid supply pipe 411 is formed from a flexible tube, and the middle portion of the liquid supply pipe 411 is provided with a relay unit 413 for relaying the liquid supply pipe 411 such that a portion of the secondary tank 412 side of the liquid supply pipe 411 is movable correspondingly to movement of the secondary tank 412 being moved together with the main carriage 61.

The secondary tank 412 is connected to one of a plurality of ends of twelve branching tubules 414 corresponding to the twelve droplet ejecting heads 111, and the other ends of the branching tubules 414 are connected to twelve inlets 112, corresponding to the droplet ejecting heads 111 provided in the head unit 11, respectively. In FIG. 6, for the purpose of easy vision, only two of the twelve branching tubules 414 are shown.

Respective middle portions of the branching tubules 414 are provided with cut-off valves 415. The ejection liquid passing through the liquid supply pipe 411 is introduced into the secondary tank 412, its pressure is adjusted in the secondary tank 412, and then the ejection liquid is supplied to the respective droplet ejecting heads 111 through the respective branching tubules 414.

The cut-off valves 415 cut off the flow paths of the branching tubules 414 when a negative pressure control unit for adjusting the pressure in the secondary tank 412 does not work due to any cause, so that the ejection liquid is prevented from flowing continuously into the droplet ejecting heads 111 at a position lower than that of the secondary tank 412 from the secondary tank 412, and from leaking from the droplet ejecting heads 111.

Figure 8:
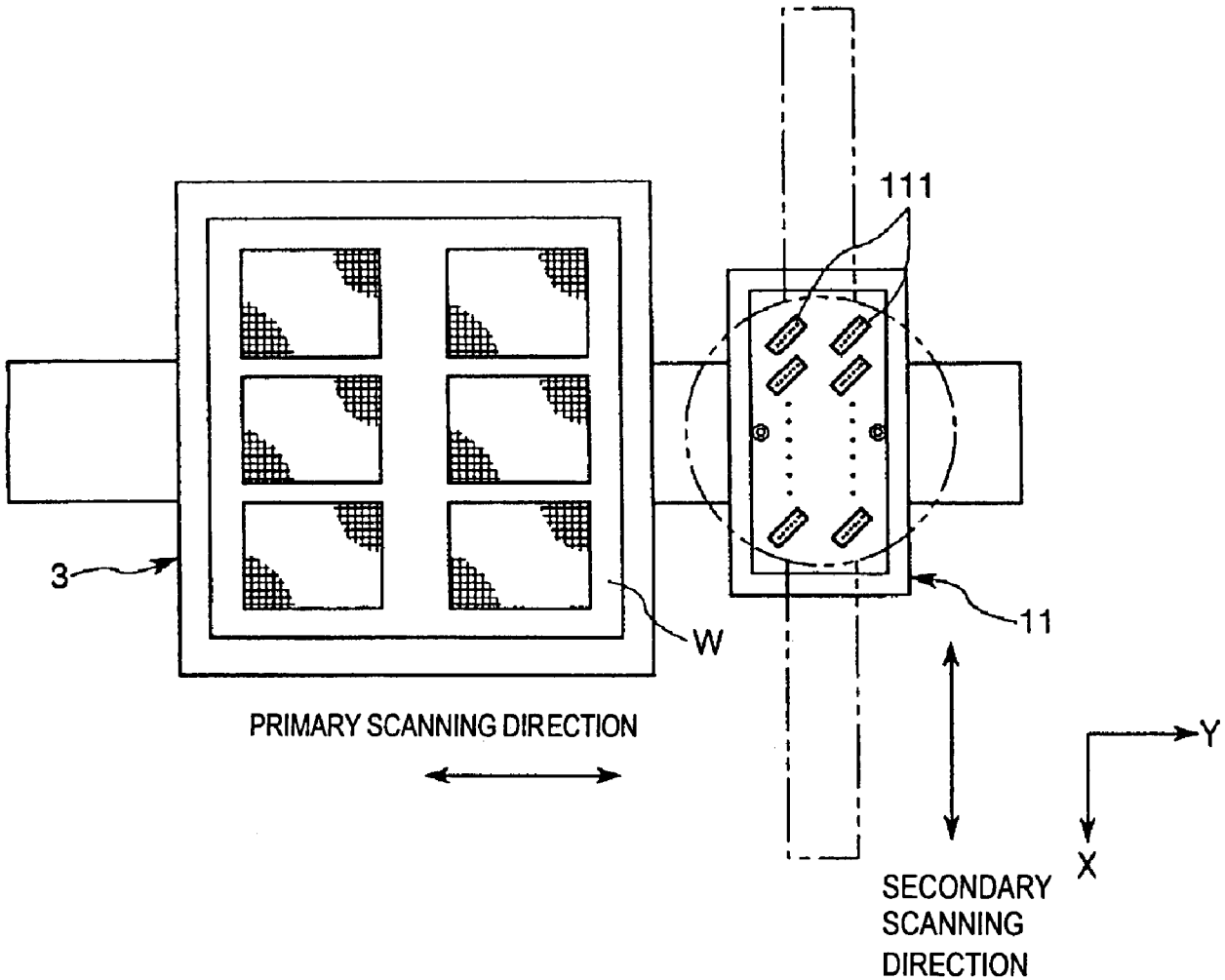
FIG. 8 is a plan view schematically illustrating a configuration of the head unit and an operation of ejecting liquid droplets according to a principle of the present invention.

FIG. 8 is a plan view schematically illustrating a configuration of the head unit and the liquid droplet ejecting operation in the liquid droplet ejecting apparatus shown in FIGS. 1 and 2. As shown in FIG. 8, in the nozzle formed surface of each droplet ejecting head 111, a plurality of ejecting nozzles (holes) for ejecting the liquid droplets are formed to be arranged in one or more lines. Each droplet ejecting head 111 has a piezoelectric element which is displaced (deformed) by means of the application of a voltage, and the liquid droplets are ejected from the corresponding ejection nozzle, by varying the pressure in a pressure room (liquid room) formed to communicate with the ejection nozzle by using displacement (deformation) of the piezoelectric element.

In addition, the droplet ejecting heads 111 are not limited to the aforementioned configuration, and may have, for example, a configuration such that the liquid droplets are heated and boiled by means of a heater and the liquid droplets are ejected from the ejection nozzles by means of its pressure.

The head unit 11 is provided with a plurality of droplet ejecting heads 111 (hereinafter, described as twelve droplet ejecting heads). The droplet ejecting heads 111 are arranged in the secondary scanning direction (the X-axis direction) to form two lines in which six droplet ejecting heads are arranged every line, and the nozzle lines of the droplet ejecting heads 111 are arranged obliquely at a predetermined angle about the secondary scanning direction.

The aforementioned arrangement pattern of the droplet ejecting heads is only an example, and the droplet ejecting heads 111 adjacent each other in each line of heads may be arranged to form an angle of 90° (that is, the adjacent heads form a "truncated chevron" shape), or the droplet ejecting heads 111 may be arranged such that the heads between the lines of heads form an angle of 90° (that is, the inter-line heads form a "truncated chevron" shape). At any rate, the dots of the overall ejecting nozzles of the plural droplet ejecting heads 111 should be continuous in the secondary scanning direction.

Further, the droplet ejecting heads 111 may not be provided with a posture oblique about the secondary scanning direction, and the plurality of droplet ejecting heads 111 may be arranged in a zigzag shape, a step shape, etc. Furthermore, as long as a nozzle line (dot line) having a predetermined length can be formed, the arrangement may have a single droplet ejecting head 111. Furthermore, the main carriage 61 may be provided with a plurality of head units 11.

Next, the blowing unit 14 will be described.

As shown in FIGS. 2 and 6, the main body 2 is provided with the blowing unit 14 for blowing a gas towards the substrate W supported by the substrate carrying table 3 to dry (preliminarily dry (semi-dry) and/or mainly dry) the liquid droplets ejected to the substrate W, wherein the gas has almost the same condition as an atmosphere in the chamber 91 in which the liquid droplet ejecting apparatus 1 is placed.

The blowing unit 14 has a nozzle 142 formed in a slit shape along the X-axis direction, and blows a gas towards the substrate W from the nozzle 142 while carrying the substrate W in the Y-axis direction by means of the substrate carrying table 3. In the liquid droplet ejecting apparatus 1 according to this embodiment, two blowing units 14 are provided, respectively, at two positions of the main body 2 separated in the Y-axis direction from each other, with the droplet ejecting heads 111 therebetween.

Now, a pair of blowing units 14 will be described, but their structures and operation are the same, so that one side (the left side in FIGS. 2 and 6) blowing unit 14 will be described representatively.

Figure 12:
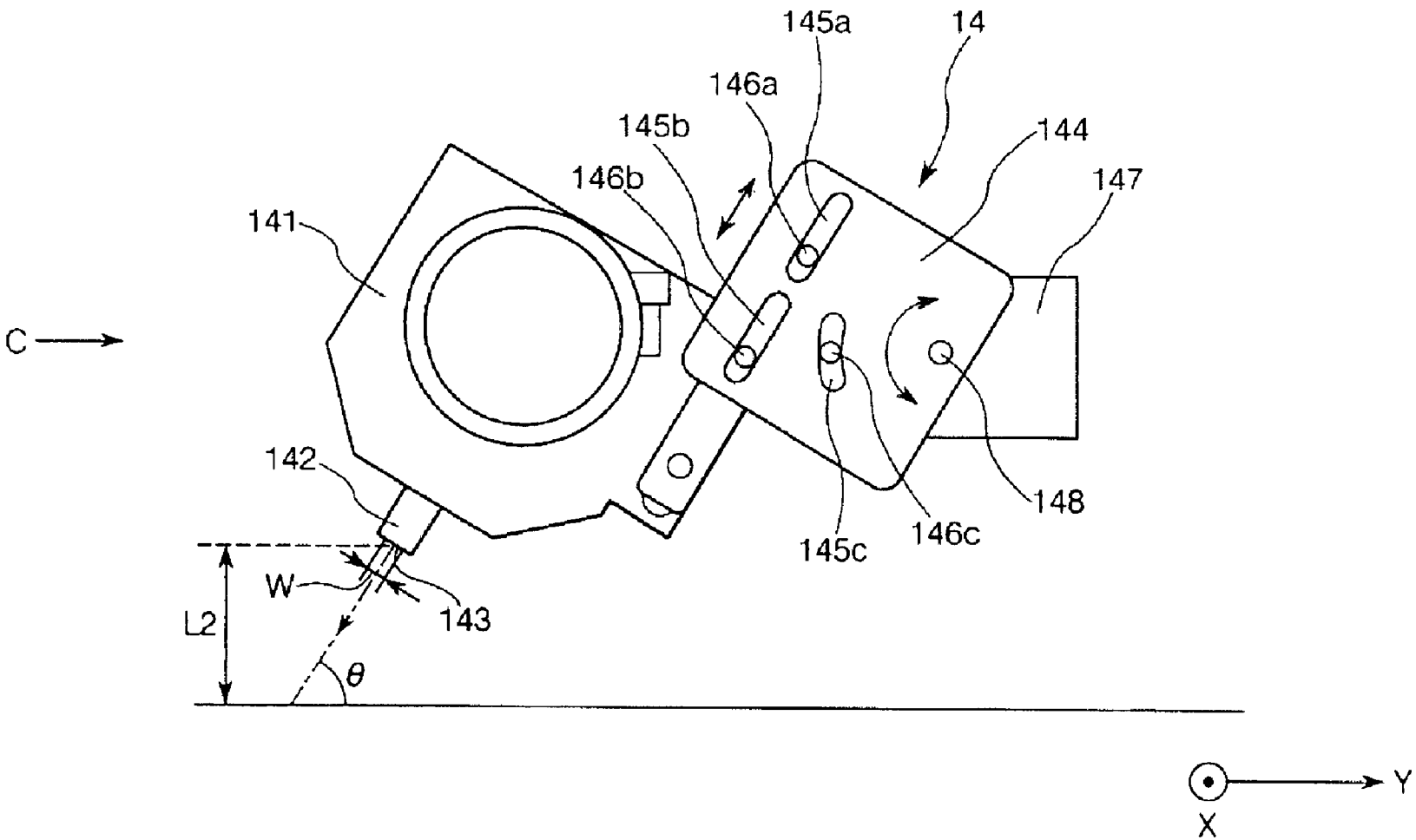
FIG. 12 is a side view illustrating a blowing unit according to a principle of the present invention.
Figure 13:
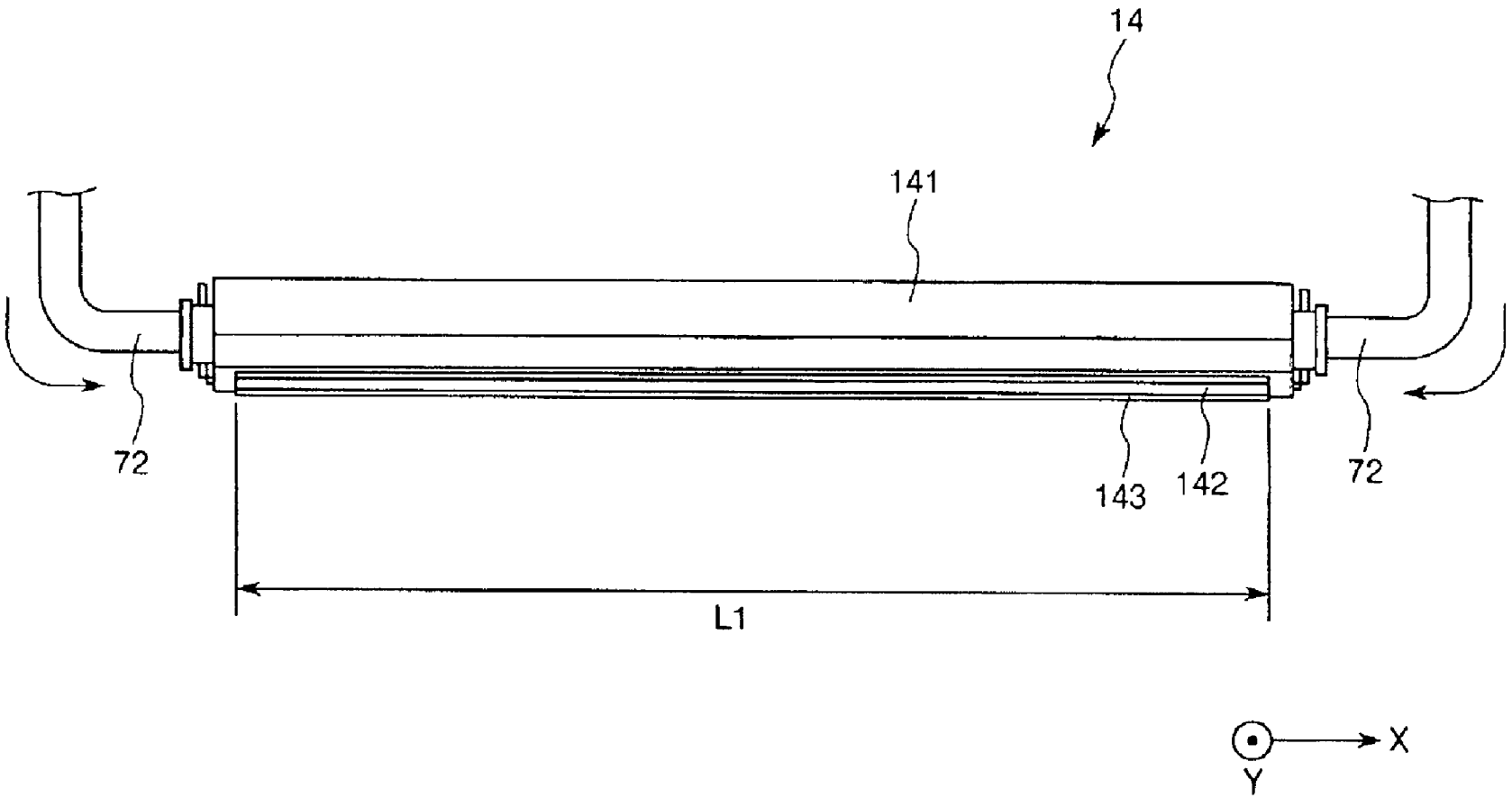
FIG. 13 is a front view of the blowing unit seen from an arrow C in FIG. 12.

FIG. 12 is a side view illustrating the blowing unit in the liquid droplet ejecting apparatus shown in FIG. 1. FIG. 13 is a front view of the blowing unit seen from an arrow C in FIG. 12, and FIG. 14 is a diagram schematically illustrating the drying operation of the blowing unit.

As shown in FIGS. 12 and 13, the blowing unit 14 has a longitudinal casing 141 extending in the X-axis direction, a pair of support plates 144, and a pair of stays 147.

A nozzle 142 formed in a slit shape in the X-axis direction is provided under the casing 141. That is, a slit (opening) 143 is formed in the X-axis direction in the nozzle 142, and the slit 143 communicates with a hollow portion in the casing 141. As a result, the gas can be uniformly blown in the X-axis direction to the substrate W, so that it is possible to uniformly dry the entire substrate W.

The X-directional length L1 of the slit 143 is set to be larger than the X-directional length of the substrate W. Accordingly, the gas can be blown to the substrate W from one end in the X-axis direction to the other end thereof, so that it is possible to dry the entire substrate W.

Herein, in the blowing unit 14, the width W of the slit (opening) 143 of the nozzle 142 can be varied. This configuration is not shown, but an example thereof is explained in the following description.

The nozzle 142 has a pair of plates arranged to face each other, and a gap between the pair of plates constitutes the slit 143. The pair of plates is provided to be relatively movable (displaced) in the direction (the width direction) of the width W of the slit 143.

In addition, the casing 141 is provided with opening-width adjusting means comprising a screw or a lead screw not shown for relatively moving the pair of plates.

By moving the pair of plates by using the opening-width adjusting means, the width W of the slit 143 can be adjusted. If the pair of plates is moved in the direction in which they are separated, the width W of the slit 143 is increased, and if the pair of plates are moved in the direction in which they approach each other, the width W of the slit 143 is decreased.

Therefore, since the width W of the slit 143 can be adjusted into an appropriate value by means of the opening-width adjusting means in accordance with various conditions such as the kind of the liquid droplets to be used, the flow rate of the gas to be blown, etc., it is possible to perform the drying under an appropriate condition.

The width W of the slit 143 is set to an appropriate value in accordance with various conditions such as the kind of the liquid droplets to be used, the flow rate of the gas to be blown, etc., but it is preferably 0.1 to 10 mm.

In addition, the direction of the nozzle 142 in FIG. 12, that is, the blowing direction of the gas blown from the nozzle 142, is toward an opposite side (a left side in FIG. 12) of the droplet ejecting head 111, and is set to an oblique direction (the direction in which an angle θ in FIG. 12 is an acute angle).

As a result, for example, even when the drying is performed while ejecting the liquid droplets to the substrate W, the ejection of liquid droplets is not influenced by the gas to be blown to the substrate W, so that it is possible to form (draw) a pattern from the ejection liquid droplets with high accuracy.

The casing 141 is arranged to be movable with respect to the pair of support plates 144. That is, substantially line-shaped longitudinal holes 145*a* and 145*b* are formed in the support plates 144, respectively, and pins (projections) 146*a* and 146*b* inserted into the longitudinal holes 145*a* and 145*b* are formed at both ends of the casing 141 in the X-axis direction, respectively, so that the pins 146*a* and 146*b* can be moved along the longitudinal holes 145*a* and 145*b*, respectively.

In addition, the respective support plates 144 can be rotated about an axis 148 relative to the corresponding stays 147. In this case, substantially arc-shaped longitudinal holes 145*c* are formed in the support plates 144, respectively, and pins (projections) 146*c* inserted into the longitudinal holes 145*c* are formed in the respective stays 147, so that the pins 146*c* can be moved along the longitudinal holes 145*c*.

The pins 146*a* and 146*b* may be replaced with, for example, male screws screwed to the casing 141. In this case, when the casing 141 is moved relative to the support plates 144, the male screws are loosened and after movement, the male screws are fastened.

Further, the pins 146*c* may be replaced with, for example, male screws screwed to the stays 147. In this case, when the support plates 144 are rotated relative to the stays 147, the male screws are loosened and after rotation, the male screws are fastened.

As shown in FIGS. 2 and 6, the stays 147 are fixedly provided at the left side in FIGS. 2 and 6 of the bar 24 in the main body 2.

As shown in FIG. 12, when the casing 141 or the support plates 144 are operated upwardly or downwardly in FIG. 12 with respect to the stays 147, the casing 141 and the support plates 144 are integrally rotated about the axis 148 relative to the stays 147, so that the direction of the casing 141 is varied. In this case, the casing 141 and the support plates 144 can be rotated until the pins 146*c* come in contact with the ends of the longitudinal holes 145*c*.

As a result, the blowing angle (the spraying angle) 0 of the gas to be blown from the nozzle 142 of the blowing unit 14 to the substrate carrying table 3 (the substrate W) can be adjusted.

Therefore, the support plates 144 and the stays 147 constitute blowing-angle adjusting means for adjusting the blowing angle (the spraying angle) θ, and since the blowing angle θ of the gas can be adjusted to an appropriate value in accordance with various conditions such as the kind of the liquid droplets to be used, the flow rate of the gas to be blown, etc. by using the blowing-angle adjusting means, it is possible to perform the drying under an appropriate condition.

Further, when the casing 141 is operated upwardly or downwardly, as in FIG. 12, along the longitudinal holes 145*a*, 145*b* with respect to the support plates 144, the casing 141 is moved along the longitudinal holes 145*a*, 145*b* relative to the support plates 144. In this case, the casing 141 can be moved until the pins 146*a*, 146*b* come in contact with the ends of the longitudinal holes 145*a*, 145*b*.

As a result, the distance between the blowing unit 14 and the substrate carrying table 3 (the substrate W) can be adjusted.

Therefore, the casing 141 and the support plates 144 constitute distance adjusting means for adjusting the distance from the substrate carrying table 3 (the substrate W), and since the distance L2 between the surface of the substrate W and a front end of the nozzle 142 of the blowing unit 14 can be adjusted into an appropriate value in accordance with various conditions such as the kind of the liquid droplets to be used, the flow rate of the gas to be blown, etc. by using the distance adjusting means, it is possible to perform the drying under an appropriate condition.

Herein, the blowing angle (the spraying angle) θ of the gas to be blown from the nozzle 142 of the blowing unit 14 to the substrate carrying table 3 (the substrate W) can be set appropriately in accordance with various conditions such as the kind of the liquid droplets to be used, the flow rate of the gas to be blown, etc., but it is preferably 30° to 75°.

Furthermore, the distance L2 between the surface of the substrate W and the front end of the nozzle 142 of the blowing unit 14 can be set appropriately in accordance with various conditions such as the kind of the liquid droplets to be used, the flow rate of the gas to be blown, etc., but it is preferably 0.1 to 100 mm, and more preferably 15 to 50 mm.

As shown in FIG. 2, the liquid droplet ejecting apparatus 1 has an air conditioning apparatus (temperature and humidity adjusting means) 71 outside the chamber 91. The air conditioning apparatus 71 has, for example, a known air conditioner and a known air blower built in, and generates and sends air (adjusted air) whose temperature and humidity are adjusted.

One end of the tube 72 is connected to the outlet of the adjusted air of the air conditioning apparatus 71, and the other end of the tube 72 is branched into two tubes in the middle thereof, and the two tubes are connected to both ends in the X-axis direction of the casing 141 of the blowing unit 14 to communicate with the hollow portion of the casing 141, as shown in FIG. 13.

The adjusted air (gas) sent from the air conditioning apparatus 71 is supplied to the hollow portion in the casing 141 of the blowing unit 14 through the tube 72, and is blown from the slits 143 of the nozzle 142.

As described above, the gas to be blown from the blowing unit 14, that is, the gas generated and sent from the air conditioning apparatus 71, is a gas having conditions, such as a kind, a temperature, a humidity, etc. of gas, almost equal to those of the atmosphere in the chamber 91 in which the liquid droplet ejecting apparatus 1 is placed.

As a result, it is possible to dry (preliminarily dry and/or mainly dry) the liquid droplets ejected to the substrate W without destroying the atmosphere (environment) in the chamber 91 and without thermally expanding the substrate W. Accordingly, it is possible to always stably form (draw) a pattern from the ejected liquid droplets with high accuracy.

That is, the kind of the gas to be blown from the blowing unit 14 is equal to the atmosphere in the chamber 91. Therefore, for example, when the chamber 91 is supplied and filled with air, the blowing unit 14 blows the air, and when the chamber 91 is supplied and filled with an inert gas such as nitrogen, carbon dioxide, helium, neon, argon, krypton, xenon, radon, etc., the blowing unit 14 blows the same kind of inert gas.

When the temperature of the atmosphere in the chamber 91 is set to a, the temperature of the gas to be blown from the blowing unit 14 is preferably a±1° C., more preferably a±0.2° C., and further more preferably a±0.1° C. In particular, when temperature control error of the temperature a of the atmosphere in the chamber 91 is set to ±0.2° C., the temperature of the gas to be blown from the blowing unit 14 is preferably a±2d° C., and more preferably a ±d° C. As a result, it is possible to form (draw) a pattern from the ejected liquid droplets with higher accuracy.

In addition, the temperature a of the atmosphere in the chamber 91 can be appropriately set in accordance with various conditions such as the kind of liquid droplets to be used, the kind of gas, the kind of the substrate W, etc., but it is preferably 15 to 30° C., and more preferably 19 to 26° C.

When the humidity of the atmosphere in the chamber 91 is set to b, the humidity of the gas to be blown from the blowing unit 14 is preferably b±30%, more preferably b±10%, and further more preferably b±5%. Specifically, when a humidity control error of the humidity b of the atmosphere in the chamber 91 is set to ±e % (where "%" is a unit of humidity), the humidity of the gas to be blown from the blowing unit 14 is preferably b±2e %, and more preferably b±e %. As a result, it is possible to form (draw) a pattern from the ejected liquid droplets with higher accuracy.

The humidity b of the atmosphere in the chamber 91 can be appropriately set in accordance with various conditions such as the kind of liquid droplets to be used, the kind of gas, the kind of the substrate W, etc., but it is preferably 20 to 70%, and more preferably 30 to 60%.

In addition, the flow rate of the gas to be blown from the blowing unit 14 can be appropriately set in accordance with various conditions such as the kind of liquid droplets to be used, the kind of gas, the size of the nozzle 142, etc., but it is preferably 100 ml/min through 10 kl/min, and more preferably 500 ml/min through 5 kl/min.

Since the liquid droplet ejecting apparatus 1 has the air conditioning apparatus (temperature and humidity adjusting means) 71, the temperature or humidity of the gas to be blown from the blowing unit 14 can be adjusted into an appropriate value even when the temperature or humidity of the atmosphere in the chamber 91 is changed, so that it is possible to perform the drying operation under an appropriate condition.

The other side (right side in FIGS. 2 and 6) blowing unit 14 is similar to the aforementioned one side (left side in FIGS. 2 and 6) blowing unit 14, and thus its description will be omitted.

As shown in FIG. 14, in drying the substrate W, two blowing units 14 blow a gas towards the substrate W while carrying the substrate W in the Y-axis direction by means of the substrate carrying table 3.

Figure 14A:
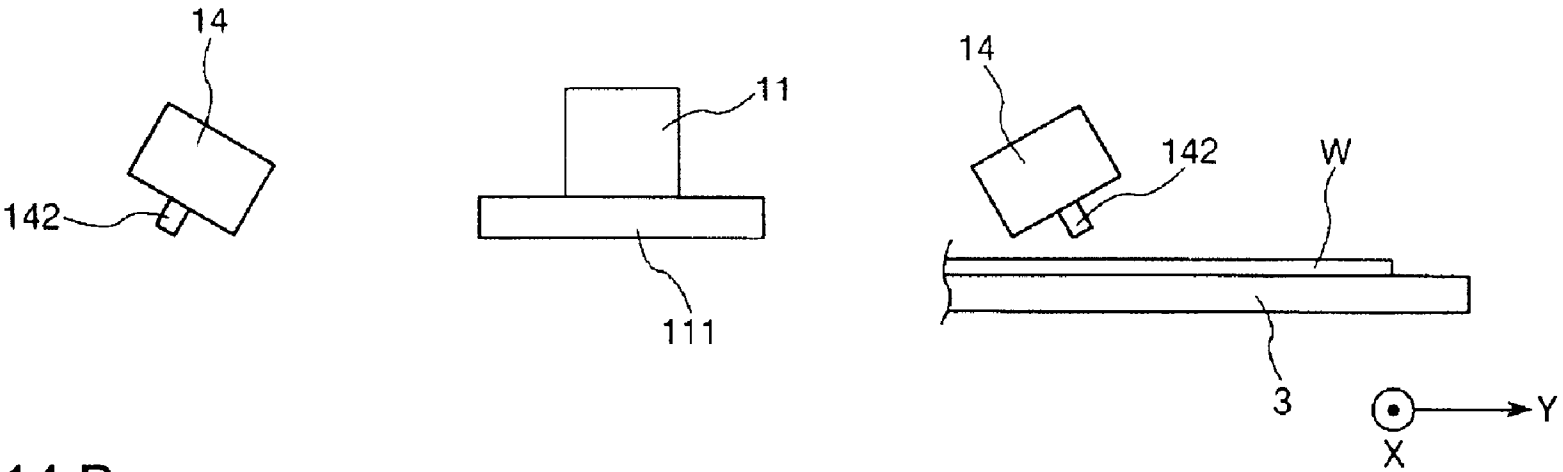
FIG. 14 is a diagram schematically illustrating a drying operation of the blowing unit according to a principle of the present invention.
Figure 14B:
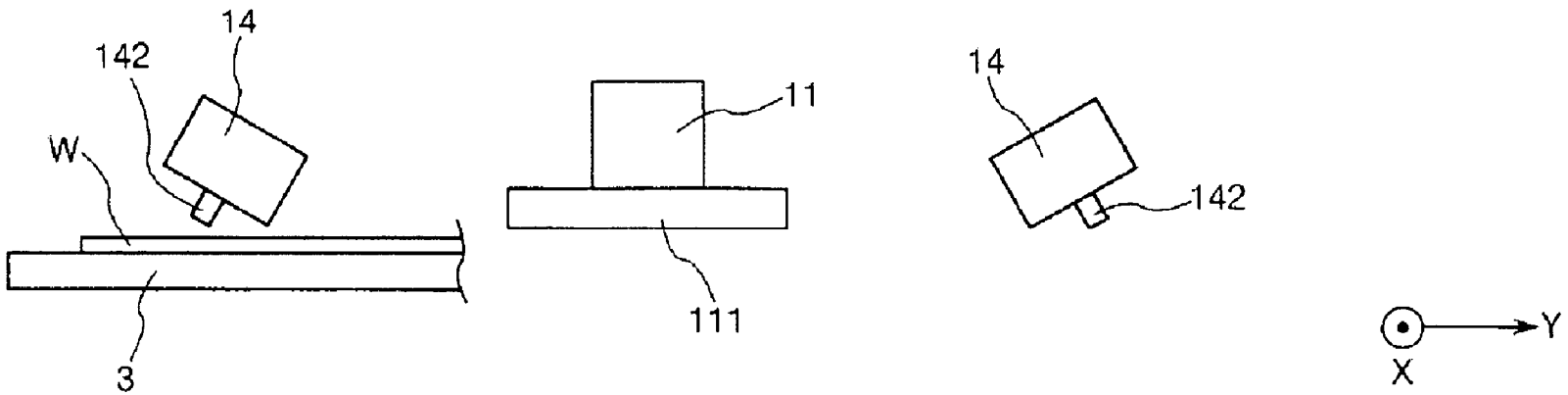

In this case, as shown in FIG. 14*b*, the driving of the Y-directional movement mechanism 5 or the blowing units 14 (the air conditioning apparatus) is controlled such that one side (the left side in FIG. 14) blowing unit 14 of the two blowing units 14 blows the gas towards a part (a left area in FIG. 14) of the substrate W to dry the part of the substrate W, and as shown in FIG. 14*a*, the other side (the right side in FIG. 14) blowing unit 14 blows the gas towards the remainder part (the right area in FIG. 14) of the substrate W to dry the remainder of the substrate W. It is preferable that the one side (the left side in FIG. 14) blowing unit 14 be made to dry almost a left half area in FIG. 14 of the substrate W, and the other side (the right side in FIG. 14) blowing unit 14 be made to dry almost a right half area in FIG. 14 of the substrate W. As a result, since the Y-directional length of the liquid droplet ejecting apparatus 1 can be shortened, it is possible to accomplish miniaturization and weight saving of the apparatus.

The operation (the gas blowing operation) of blowing the gas from the blowing unit 14 may be performed during advance (the forward movement) of the substrate carrying table 3, may be performed during retreat (the backward movement) of the substrate carrying table, and may be performed during both of advance and retreat (the reciprocating movement) of the substrate carrying table. Further, the gas blowing operation may be performed several times by reciprocating the substrate carrying table 3 several times.

In addition, the drying operation of the substrate W may be performed during ejecting the liquid droplets from the droplet ejecting heads 111 to form a pattern, and may be performed after completely forming the pattern.

In this embodiment, the two blowing units 14 are equal each to other in all conditions such as a structure, a shape, a size, etc., but a part or all thereof may be different.

Further, in this embodiment, two blowing units 14 are provided, but the number of blowing units 14 may be one, and may be three or more.

In addition, the configuration of the blowing units 14 is not limited to the configuration of this embodiment, and may be a configuration, for example, that the gas (the atmosphere) in the chamber 91 is suctioned and then the gas is blown.

Herein, the entire operation of the liquid droplet ejecting apparatus 1 controlled by the control unit 16 will be briefly described. When the substrate W is supplied onto the substrate carrying table 3 and is positioned at a predetermined position on the substrate carrying table 3 by means of operation of a substrate positioning unit (not described) provided in the liquid droplet ejecting apparatus 1 (pre-alignment), the substrate W is sucked and fixed to the substrate carrying table 3 through air suction from the suction holes 332 of the substrate carrying table 3. Next, the recognition camera 107 is moved over the alignment marks formed at a predetermined position (one or more positions) of the substrate W by means of the movement of the substrate carrying table 3 and the camera carriage 106, and then recognizes the alignment marks. On the basis of a recognition result, a θ axial rotation mechanism 105 is actuated to correct the θ axial rotation angle of the substrate W, and a correction of positions of the substrate W in the X-axis direction and the Y-axis direction is performed on data (main alignment).

When the alignment operation of the substrate W is finished, the operation of selectively ejecting liquid droplets to the substrate W from the respective droplet ejecting heads 111 is performed while moving the substrate W in the primary scanning direction (the Y-axis direction) through movement of the substrate carrying table 3 in a state where the head unit 11 is fixed. At that time, the operation of ejecting the liquid droplets may be performed during advance (forward movement) of the substrate carrying table 3, during retreat (backward movement) of the substrate carrying table 3, and during both of advance and retreat (reciprocating movement) of the substrate carrying table 3. Further, the operation of ejecting the liquid droplets may be performed several times by reciprocating the substrate carrying table 3 several times. As a result, the ejection of liquid droplets onto an area of the substrate W extending in the primary scanning direction with a predetermined width (the width which can be covered with the head unit 11) is finished.

Thereafter, the head unit 11 is moved in the secondary scanning direction (the X-axis direction) by a predetermined width, by moving the main carriage 61. In this state, similarly to the aforementioned operation, the operation of selectively ejecting the liquid droplets to the substrate W from the respective droplet ejecting heads 111 is performed while moving the substrate W in the primary scanning direction. Then, when the liquid droplet ejecting operation on the area is finished, a similar liquid droplet ejecting operation is performed while moving the substrate W in the primary scanning direction in a state where the head unit 11 is further moved in the secondary scanning direction (the X-axis direction) by the predetermined width. By repeating this operation several times, the ejection of liquid droplets on the entire area of the substrate W is finished. As a result, the liquid droplet ejecting apparatus 1 forms (draws) a predetermined pattern on the substrate W.

As described above, in the liquid droplet ejecting apparatus 1, while moving the substrate W in the primary scanning direction (the Y-axis direction) through movement of the substrate carrying table 3, the blowing units 14 are allowed to blow the gas towards the substrate W, thereby drying the liquid droplets ejected to the substrate W. As described above, the drying operation on the substrate W may be performed during ejecting of the liquid droplets from the droplet ejecting heads 111 to form a pattern, and may be performed after the pattern is completely formed.

Figure 9:
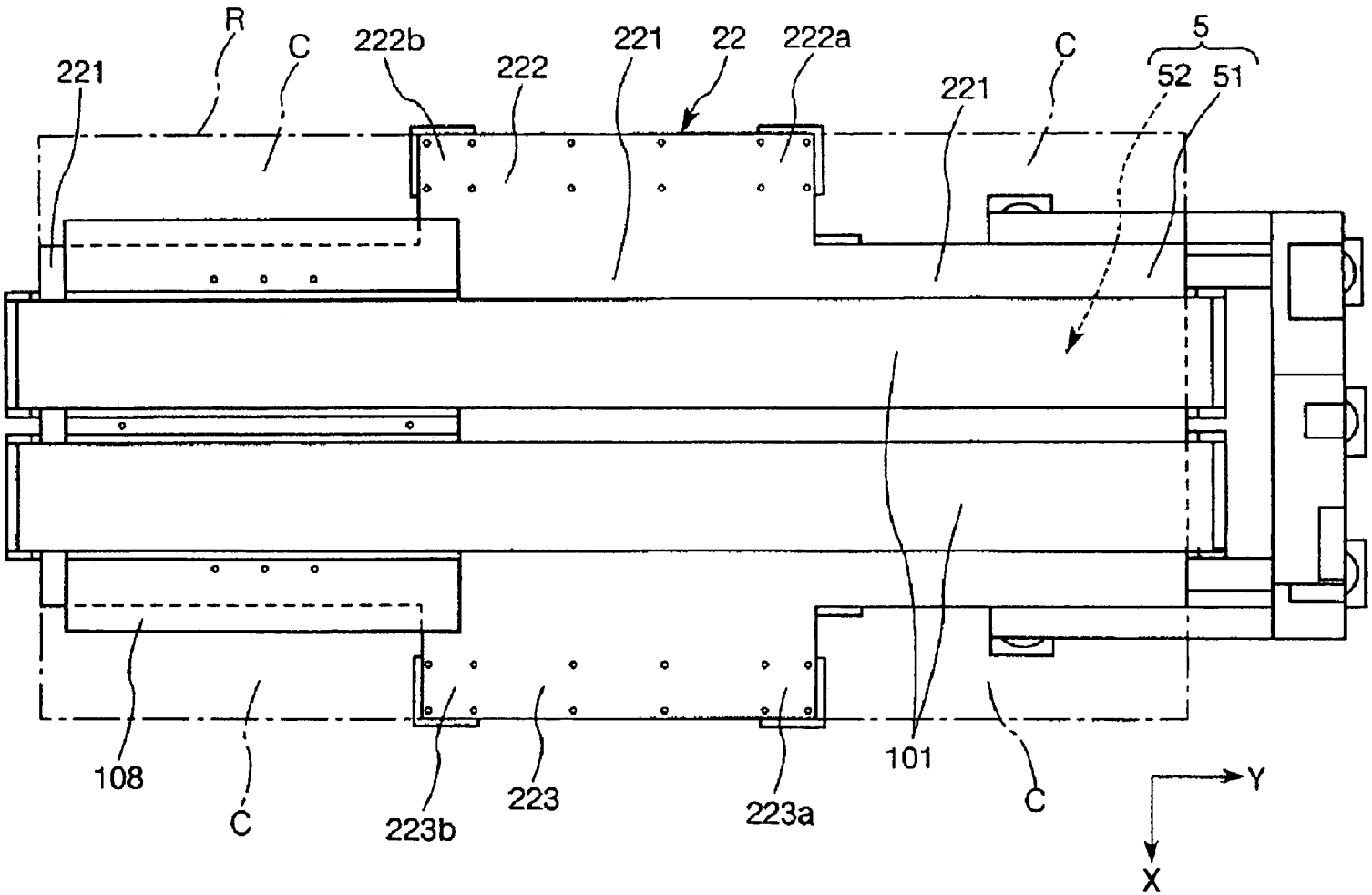
FIG. 9 is a plan view illustrating a configuration according to a principle of the present invention wherein the substrate carrying table is removed from the configuration shown in FIG. 3.
Figure 10:
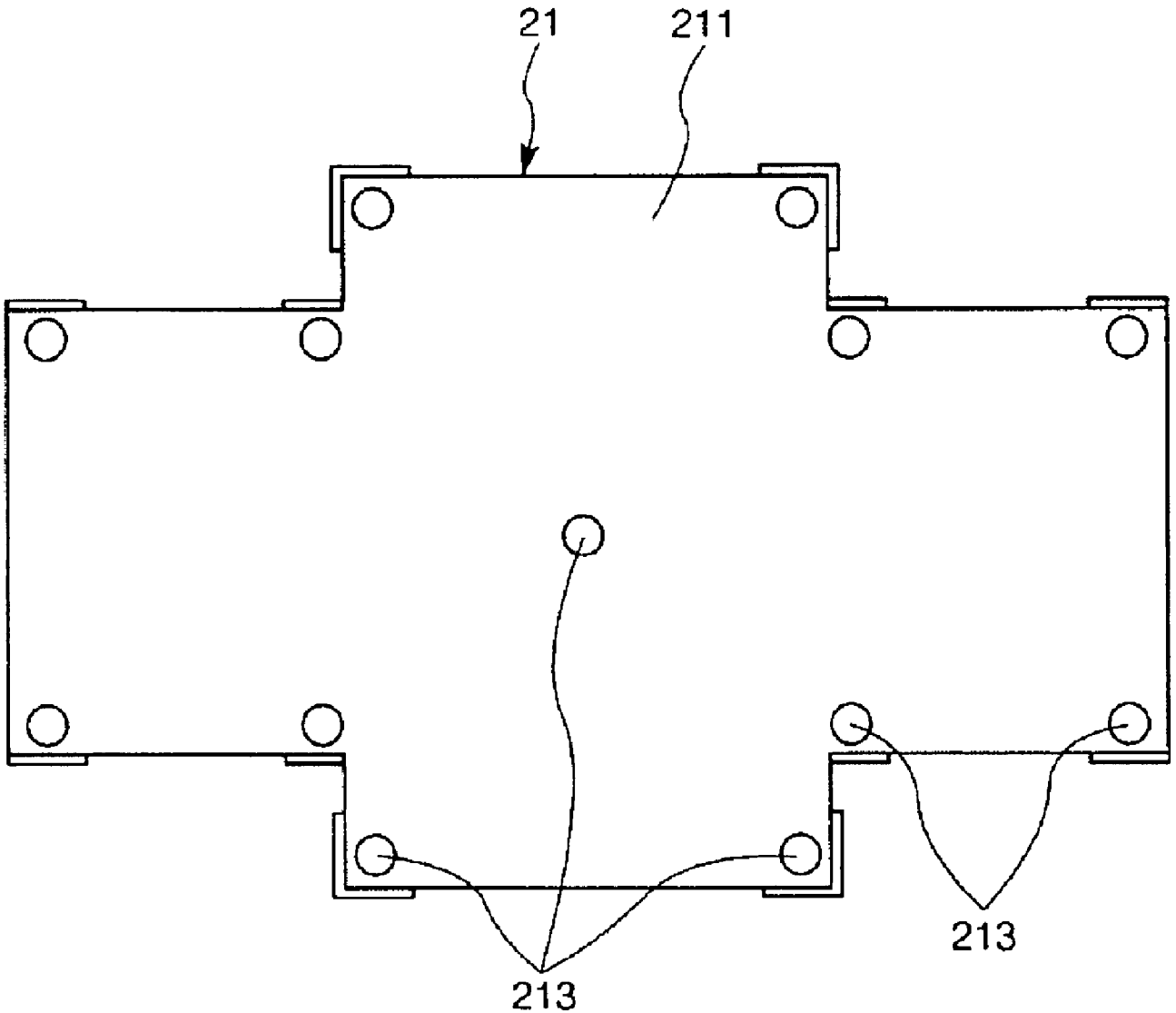
FIG. 10 is a plan view illustrating the trestle according to a principle of the present invention.

FIG. 9 is a plan view illustrating a configuration in which the substrate carrying table is removed from the configuration shown in FIG. 3, and FIG. 10 is a plan view illustrating the trestle.

As shown in FIG. 9, as seen two-dimensionally, the stone surface plate 22 comprises an Y-directional movement mechanism support 221 having a longitudinal rectangular shape of the Y-axis direction, and pillar supports 222 and 223 that protrude toward both sides in the X-axis direction from middle portions of the longitudinal direction of the Y-directional movement mechanism support 221. As a result, the stone surface plate 22 has a cross shape as seen two-dimensionally. In other words, the stone surface plate 22 has such a shape obtained by removing the four corner portions (removed portions C) from the rectangular shape, as seen two-dimensionally.

The Y-directional movement mechanism 5 is provided on the Y-directional movement mechanism support 221. In addition, the pillars 23 are provided on the four positions of the corner portions 222*a* and 222*b* of the pillar support 222 and the corner portions 223*a* and 223*b* of the pillar support 2223, respectively.

As a result, the stone surface plate 22 has such a shape as obtained by removing the portions (removed portions C) which is not provided with the Y-directional movement mechanism 5 and the pillars 23 from the rectangular shape R indicated by a one-dotted chain line in FIG. 9, as seen two-dimensionally. Accordingly, it is possible to reduce the weight, compared with a case of using the rectangular shape R itself. As a result, it is possible to facilitate the transfer of the liquid droplet ejecting apparatus 1 to an installing place thereof, and in addition to reduce load resistance of a floor in the installing place of a plant.

Since an area occupied with the stone surface plate 22 can be reduced by the removed portions C, it is possible to accomplish miniaturization of the entire liquid droplet ejecting apparatus 1. That is, a space saving can be obtained by providing piping components, electric equipment components, etc. in the removed portions C. The removed portions C can also be used as a space for maintenance of the apparatus. Therefore, the occupied area in a plant can be reduced, and the transfer of the liquid droplet ejecting apparatus 1 to its installing place can be facilitated. Furthermore, when the liquid droplet ejecting apparatus 1 is housed and operated in the chamber 91, there is an advantage that the chamber 91 can be made with a reduced size.

As a result, by using the liquid droplet ejecting apparatus 1, it is possible to form (draw) a pattern on a work such as the substrate W at low cost.

In this embodiment, the Y-directional movement mechanism 5, as seen two-dimensionally, is parallel to the longitudinal direction of the stone surface plate 22, and is provided in a state such that its central line accords with a central line of the stone surface plate 22 (a central line in the longitudinal direction of the stone surface plate 22). As seen two-dimensionally, the X-directional movement mechanism 6 is perpendicular to the longitudinal direction of the stone surface plate 22, and is provided in a state that its central line accords with a central line of the stone surface plate 22 (a central line in the width direction of the stone surface plate 22). Accordingly, the Y-directional movement mechanism 5 and the X-directional movement mechanism 6 are intersected in a cross shape at a mutual center position and are provided at the center of the stone surface plate 22. As a result, it is possible to support the Y-directional movement mechanism 5 and the X-directional movement mechanism 6 on the stone surface plate 22 with better balance.

Further, in this embodiment, the Y-directional movement mechanism 5 extends parallel to the longitudinal direction of the stone surface plate 22, and is mounted directly on the stone surface plate 22. Accordingly, it is possible to stably support the Y-directional movement mechanism 5 with higher accuracy (flatness).

Furthermore, in this embodiment, the X-directional movement mechanism 6 is provided to extend over the Y-directional movement mechanism 5 through the four pillars 23, and the four pillars 23 are, as seen two-dimensionally, symmetrically distributed and arranged about the central line in the longitudinal direction of the stone surface plate 22. As a result, it is possible to stably support the X-directional movement mechanism 6 with higher accuracy (flatness).

As shown in FIG. 10, the trestle 21 supporting the stone surface plate 22 has almost the same shape (a cross shape) as the stone surface plate 22 as seen two-dimensionally. As a result, it is possible to further accomplish reduction of the entire weight (weight saving) and miniaturization (space saving) of the liquid droplet ejecting apparatus 1. The trestle 21 supports the stone surface plate 22 through three (three positions) or more supports 213. The supports 213 has a height adjusting mechanism, for example, using an adjusting bolt, etc., and by adjusting the heights of the respective supports 213, a flatness and a levelness of the top surface of the stone surface plate 22 can be adjusted.

Figure 11:
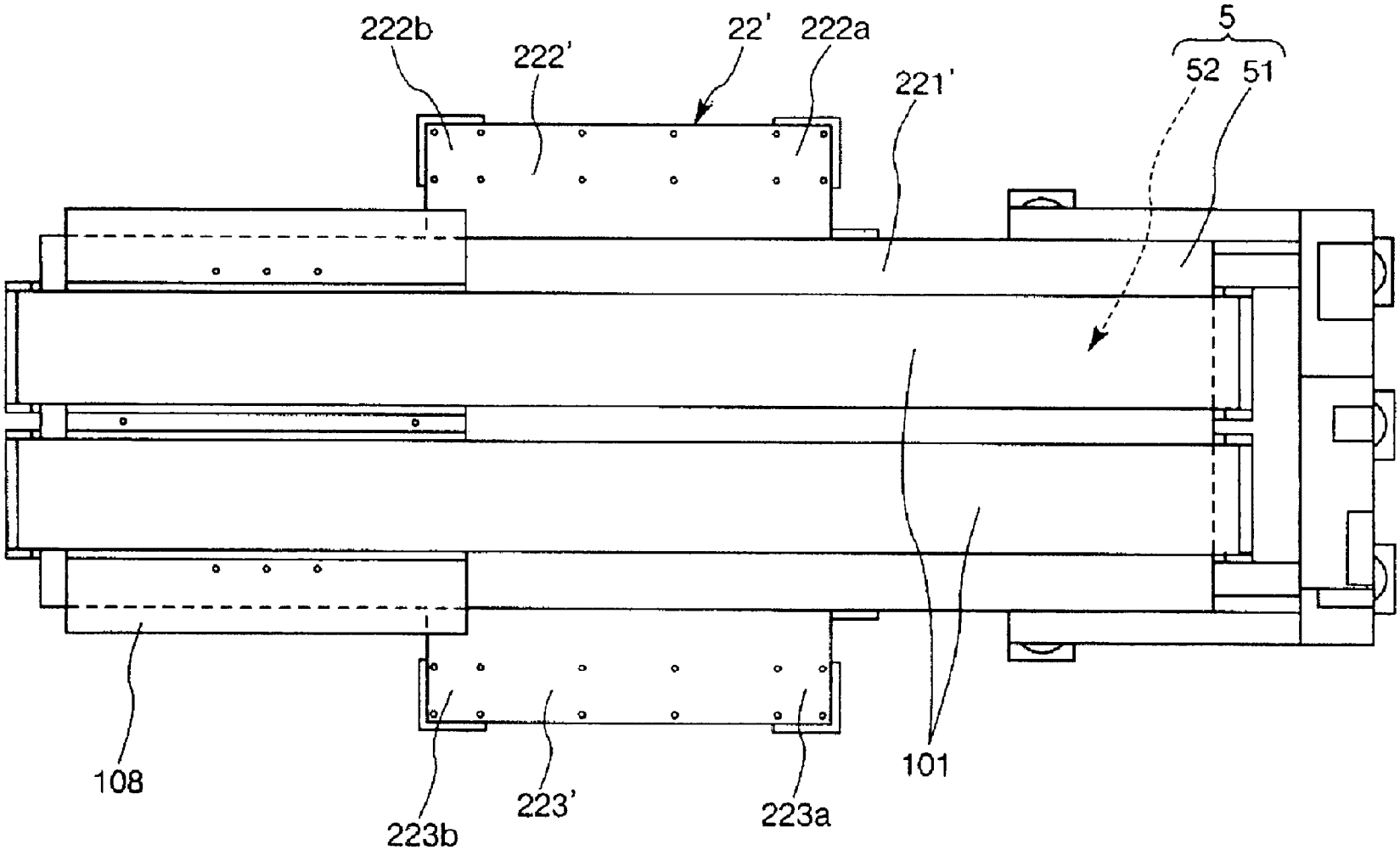
FIG. 11 is a plan view illustrating another structural example of the stone surface plate according to a principle of the present invention.

FIG. 11 is a plan view illustrating another structural example of the stone surface plate. Although the stone surface plate 22 is formed from one stone in the aforementioned embodiment, the Y-directional movement mechanism support 221', the pillar support 222' and the pillar support 223' are formed from individual stones in the stone surface plate 22' shown in FIG. 11. In addition, the stone surface plate 22' is constructed by combining the three stones and coupling them to each other through fixing members, not shown.

In this way, by combining a plurality of stones to construct the stone surface plate 22', it is possible to easily and inexpensively manufacture the stone surface plate 22' having a shape other than the rectangular shape. Furthermore, since the stone surface plate 22' can be divided and transferred to the installing place, it is possible to easily transfer it.

When a plurality of stones is combined to construct the stone surface plate 22', boundaries for dividing the stone surface plate are not limited to the illustrated construction, and the stone surface plate may be divided into three stones, for example, in a transverse direction, as in FIG. 11.

As described above, although the liquid droplet ejecting apparatus and the liquid droplet ejecting system according to the present invention have been described in conjunction with the shown embodiments, the present invention is not limited to the embodiments, and the respective elements constituting the liquid droplet ejecting apparatus and the liquid droplet ejecting system may be replaced with any element having the same function. In addition, any element may be added thereto.

For example, the Y-directional movement mechanism and the X-directional movement mechanism may use a ball screw (a feed screw) in place of the linear motor.

As described above, according to the present invention, since the blowing units 14 are allowed to blow towards the substrate W a gas having almost the same condition as the atmosphere in the chamber 91 in which the liquid droplet ejecting apparatus 1 is placed to dry the liquid droplets ejected to the substrate W, it is possible to dry the liquid droplets ejected to the work piece without disturbing the atmosphere (environment) in the chamber 91 and without thermally expanding the substrate W. As a result, it is possible to always stably form (draw) a pattern from the ejected liquid droplets with high accuracy.

When drying the liquid droplets ejected to the substrate W, the present invention has the following advantages, compared with the method of carrying the substrate W to a pre-bake furnace to dry the substrate.

First, since the liquid droplet ejecting apparatus 1 has the blowing units 14, the liquid droplets ejected to the substrate W can be dried in the liquid droplet ejecting apparatus 1.

That is, in a case of alternately and repeatedly performing the ejection of liquid droplets to the substrate W and the drying of liquid droplets ejected to the substrate W, when the method of performing the drying operation in the pre-bake furnace is used, a lot of time is taken for supplying and removing the substrate, and an alignment operation is required specifically when the substrate W is re-supplied to the liquid droplet ejecting apparatus 1. However, in the present invention, since the drying operation can be performed in the liquid droplet ejecting apparatus 1, the supply and removal of the substrate or the alignment is not required. As such, it is possible to enhance throughput (production efficiency).

Since the liquid droplet ejecting apparatus 1 is provided and used in the chamber 91 whose inner atmospheric condition is controlled, specifically in a case of alternately and repeatedly performing the ejection of liquid droplets to the substrate W and the drying of liquid droplets ejected to the substrate W, the atmosphere (environment) in the chamber is destroyed in the drying operation (supply and removal of a work) when the method of performing the drying operation in the pre-bake furnace is used, so that time for restoring the destroyed atmosphere to an original condition (an appropriate condition) (time for purging nitrogen again, for example, when nitrogen is purged in the chamber) is required. However, in the present invention, since the drying operation can be performed in the liquid droplet ejecting apparatus 1, the atmosphere (environment) in the chamber 91 is not destroyed. As such, it is possible to enhance throughput (production efficiency).

Furthermore, in a case of alternately and repeatedly performing the ejection of liquid droplets to the substrate W and drying of liquid droplets ejected to the substrate W, since the substrate W is heated when the method of performing the drying operation in a pre-bake furnace is used, time for restoring the work again to an appropriate temperature (environmental temperature) is required. However, in the liquid droplet ejecting apparatus 1, since the drying operation is performed by blowing a gas having almost the same condition as the atmosphere in the chamber 91, the substrate W has the appropriate temperature (environmental temperature) even right after performing the drying operation, so that subsequent processes can be carried out right after the drying operation. Therefore, it is possible to enhance throughput (production efficiency).

The method of performing the drying operation in the pre-bake furnace requires an installing space larger than the size of the substrate W for installing the pre-bake furnace outside the liquid droplet ejecting apparatus, so that the entire system is enlarged. However, in the liquid droplet ejecting apparatus 1, since the liquid droplet ejecting apparatus 1 has the blowing units 14, the entire system can be miniaturized.

Use of the liquid droplet ejecting apparatus according to the present invention is not particularly limited, but may be used preferably for forming a metal wiring line.

A method of forming a metal wiring line according to the present invention uses the liquid droplet ejecting apparatus according to the present invention. In the method of forming a metal wiring line according to the present invention, a liquid (a liquid-state metal material) containing a metal material is selectively ejected to a substrate by using the liquid droplet ejecting apparatus according to the present invention, and then the liquid is dried by means of the blowing unit, thereby forming a dried film for metal wiring lines on the substrate. Next, the substrate is taken out from the liquid droplet ejecting apparatus, and the substrate is subjected to a heat treatment and/or an optical treatment. As a result, electrical contact between particulates of the dried film is secured, and the dried film is converted into a conductive film, thereby forming metal wiring lines on the substrate.

The method of forming a metal wiring line according to the present invention can be applied for forming, for example, metal wiring lines connecting a driver and respective electrodes in a liquid crystal display device, metal wiring lines connecting TFTs, etc. and respective electrodes in an organic EL (electroluminescence) display device, various antenna circuits, etc.

An electro-optical device according to the present invention is manufactured using the liquid droplet ejecting apparatus according to the present invention described above. A specific example of the electro-optical device according to the present invention is not particularly limited, and may include, for example, a liquid crystal display device, an organic EL display device, etc.

Furthermore, a method of manufacturing an electro-optical device according to the present invention employs the liquid droplet ejecting apparatus according to the present invention. The method of manufacturing an electro-optical device according to the present invention can be applied, for example, to a method of manufacturing a liquid crystal display device. That is, by selectively ejecting a liquid containing filter materials for respective colors to a substrate by using the liquid droplet ejecting apparatus according to the present invention, a color filter in which a plurality of filter elements are arranged on the substrate can be manufactured, and the liquid crystal display device can be manufactured by using the color filter. In addition, the method of manufacturing an electro-optical device according to the present invention can be applied to a method of manufacturing, for example, an organic EL display device. That is, by selectively ejecting a liquid containing light emitting materials for respective colors to a substrate by using the liquid droplet ejecting apparatus according to the present invention, an organic EL display device in which a plurality of pixels including EL light emitting layers are arranged on the substrate can be manufactured.

Furthermore, an electronic apparatus according to the present invention comprises the electro-optical device manufactured in the aforementioned way. A specific example of the electronic apparatus according to the present invention is not particularly limited, and may include a personal computer, a mobile phone, etc. equipped with the liquid crystal display device or the organic EL display device manufactured in the aforementioned way.

What is claimed is:

1. A liquid droplet ejecting apparatus comprising:

a main body;

a work piece carrying table for supporting a work piece;

a Y-directional movement mechanism for moving the work piece carrying table with the work piece in a linear Y-axis direction relative to the main body; and a droplet ejecting head for ejecting liquid droplets to the work piece supported by the work piece carrying table, and at least one blowing unit for blowing a gas towards the work piece supported by the work piece carrying table to dry the liquid droplets ejected to the work piece, the at least one blowing unit being connected to an air conditioning apparatus for controlling a condition of the gas including at least one of a temperature and a humidity of the gas;

the liquid droplet ejecting apparatus being provided and used in a chamber whose inner atmospheric condition is controlled, and the condition of the gas being controlled by the air conditioning apparatus separately from the inner atmospheric condition of the chamber to be almost equal to the inner atmospheric condition of the chamber in which the liquid droplet ejecting apparatus is placed.

2. The liquid droplet ejecting apparatus according to claim 1, wherein when a temperature of the atmosphere in which the liquid droplet ejecting apparatus is placed is set to a, and the temperature of the gas to be blown from the blowing unit is a±1° C.

3. The liquid droplet ejecting apparatus according to claim 1, wherein when a humidity of the atmosphere in which the liquid droplet ejecting apparatus is placed is set to b, and the humidity of the gas to be blown from the blowing unit is b+30%.

4. The liquid droplet ejecting apparatus according to claim 1, wherein the gas to be blown from the blowing unit is equal to that of the atmosphere in which the liquid droplet ejecting apparatus is placed.

5. The liquid droplet ejecting apparatus according to claim 1, wherein the gas to be blown from the blowing unit is air or an inert gas.

6. The liquid droplet ejecting apparatus according to claim 1, wherein the blowing unit has a nozzle formed in a slit shape in an X-axis direction perpendicular to the Y-axis direction.

7. The liquid droplet ejecting apparatus according to claim 6, wherein the blowing unit has opening-width adjusting means for adjusting the width of the opening.

8. The liquid droplet ejecting apparatus according to claim 1, wherein the blowing unit has distance adjusting means for adjusting the distance from the work piece carrying table.

9. The liquid droplet ejecting apparatus according to claim 1, wherein the blowing unit has blowing-angle adjusting means for adjusting the blowing angle of the gas blown from the blowing unit with respect to the work piece carrying table.

10. The liquid droplet ejecting apparatus according to claim 1, wherein the blowing unit has temperature and humidity adjusting means for adjusting a temperature and/or a humidity of the gas to be blown from the blowing unit.

11. The liquid droplet ejecting apparatus according to claim 1, wherein the blowing direction of the gas blown from the blowing unit is toward an opposite side of the droplet ejecting head.

12. The liquid droplet ejecting apparatus according to claim 1, wherein the blowing unit is provided in the main body.

13. The liquid droplet ejecting apparatus according to claims 1, wherein two blowing units are provided, respectively, at two positions separated in the Y-axis direction from each other, with the droplet ejecting head therebetween.

14. The liquid droplet ejecting apparatus according to claim 13, wherein one of the two blowing units is made to dry a part of the work piece, and the other is made to dry at least the remainder of the work piece.

15. The liquid droplet ejecting apparatus according to claim 1, wherein the liquid droplets ejected to the work piece are dried by moving the work piece carrying table in the Y-axis direction while allowing the blowing unit to blow the gas.

16. The liquid droplet ejecting apparatus according to claim 1, wherein a predetermined pattern is formed on the work piece by making the droplet ejecting head eject the liquid droplets while relatively moving the work piece carrying table and the droplet ejecting head.

17. The liquid droplet ejecting apparatus according to claim 1, further comprising an X-directional movement mechanism for moving the droplet ejecting head in X-axis direction perpendicular to the Y-axis direction relative to the main body.

18. The liquid droplet ejecting apparatus according to claim 17, wherein the liquid droplets are ejected to the work piece from the droplet ejecting head while relatively moving the work piece carrying table and the droplet ejecting head by using one of the Y-axis direction and the X-axis direction as a primary scanning direction and the other as a secondary scanning direction.

19. The liquid droplet ejecting apparatus according to claim 17, wherein the liquid droplets are ejected to the work piece from the droplet ejecting head while relatively moving the work piece carrying table and the droplet ejecting head by using the Y-axis direction as a primary scanning direction and the X-axis direction as a secondary scanning direction.

20. The liquid droplet ejecting apparatus according to claim 1, wherein the liquid droplet ejecting apparatus forms a metal wiring line on the work piece.

21. A liquid droplet ejecting system comprising:

a liquid droplet ejecting apparatus according to claim 1; and a chamber for housing the liquid droplet ejecting apparatus, an inner atmospheric condition of the chamber being controlled.

22. The liquid droplet ejecting system according to claim 21, further comprising an air conditioning apparatus for adjusting a temperature and/or humidity in the chamber.

* * * * *